US010674282B2

(12) United States Patent
Russell et al.

(10) Patent No.: US 10,674,282 B2
(45) Date of Patent: Jun. 2, 2020

(54) SAFETY EAR HOOK APPARATUS

(71) Applicants: Peter John Russell, Macquarie University (AU); Slobodan Ilic, Macquarie University (AU); Eddie Sze Chuen Chan, Macquarie University (AU)

(72) Inventors: Peter John Russell, Macquarie University (AU); Slobodan Ilic, Macquarie University (AU); Eddie Sze Chuen Chan, Macquarie University (AU)

(73) Assignee: Cochlear Limited, Macquarie University, NSW (AU)

( * ) Notice: Subject to any disclaimer, the term of this patent is extended or adjusted under 35 U.S.C. 154(b) by 78 days.

(21) Appl. No.: 15/652,746

(22) Filed: Jul. 18, 2017

(65) Prior Publication Data

US 2019/0028816 A1 Jan. 24, 2019

(51) Int. Cl.
*H04R 25/02* (2006.01)
*H04R 25/00* (2006.01)

(52) U.S. Cl.
CPC ..... *H04R 25/02* (2013.01); *H04R 25/65* (2013.01); *H04R 25/602* (2013.01); *H04R 25/607* (2019.05); *H04R 2225/021* (2013.01); *H04R 2460/13* (2013.01)

(58) Field of Classification Search
CPC ..... H04R 25/65; H04R 25/02; H04R 25/602; H04R 2225/021
USPC ..... 381/323
See application file for complete search history.

(56) References Cited

U.S. PATENT DOCUMENTS

| | | | | |
|---|---|---|---|---|
| 4,702,345 | A | 10/1987 | Janssen et al. | |
| 4,881,616 | A * | 11/1989 | Janssen | H04R 25/60 181/129 |
| 7,729,774 | B1 * | 6/2010 | Lynch | H04R 25/65 607/57 |
| 8,848,958 | B2 * | 9/2014 | Karlsen | H04R 25/60 381/330 |
| 2003/0031336 | A1 * | 2/2003 | Harrison | H04R 25/48 381/330 |
| 2006/0171550 | A1 * | 8/2006 | Bryant | H04R 25/60 381/330 |
| 2011/0022121 | A1 * | 1/2011 | Meskins | A61N 1/37229 607/57 |
| 2013/0101148 | A1 * | 4/2013 | Karlsen | H04R 25/65 381/323 |

(Continued)

OTHER PUBLICATIONS http://www.cochlear.com/wps/wcm/connect/au/home/support/accessories/accessories-baha-5-superpower, believed available before Jul. 2017, Cochlear Limited, accessed Dec. 14, 2017. This is believed to be prior art. Applicant reserves the right to present future evidence that this is not the case.

(Continued)

*Primary Examiner* — Sean H Nguyen
(74) *Attorney, Agent, or Firm* — Pilloff Passino & Cosenza LLP; Martin J. Cosenza

(57) ABSTRACT

An ear hook apparatus, including an ear hook tip, an ear hook chassis, and a male connector, wherein the ear hook apparatus is configured such that the male connector attaches to one or more components of a BTE device at and/or below a base of a BTE electronics module of the BTE device.

19 Claims, 44 Drawing Sheets

(56) References Cited

U.S. PATENT DOCUMENTS

2015/0350797 A1* 12/2015 Muller ..... H04R 1/1041
381/323

OTHER PUBLICATIONS http://www.cochlear.com/wps/wcm/connect/uk/home/support/baha-system/baha-5-superpower-support/accessories, believed available before Jul. 2017, Cochlear Limited, accessed Dec. 14, 2017. This is believed to be prior art. Applicant reserves the right to present future evidence that this is not the case.

http://www.cochlear.com/wps/wcm/connect/us/recipients/nucleus-6/nucleus-6-accessories/retention-options, believed available before Jul. 2017, Cochlear Limited, accessed Dec. 14, 2017. This is believed to be prior art. Applicant reserves the right to present future evidence that this is not the case.

http://www.cochlear.com/wps/wcm/connect/us/recipients/nucleus-hybrid-implant-system/hybrid-accessories/retention-options, believed available before Jul. 2017, Cochlear Limited, accessed Dec. 14, 2017. This is believed to be prior art. Applicant reserves the right to present future evidence that this is not the case.

Huggie Aids Too, "Huggie Aids Too Catalog, How Did We Do Without Them," believed available before Jul. 2017. This is believed to be prior art. Applicant reserves the right to present future evidence that this is not the case.

Martin Cosenza, "Believed Prior Art", believed to be known or used by others before Jul. 2017. This is believed to be prior art. Applicant reserves the right to present future evidence that this is not the case.

* cited by examiner

SAFETY EAR HOOK APPARATUS

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, certain types of hearing prostheses, commonly referred to as bone conduction devices, convert a received sound into mechanical vibrations. The vibrations are transferred through the skull to the cochlea causing generation of nerve impulses, which result in the perception of the received sound. Bone conduction devices may be a suitable alternative for individuals who cannot derive sufficient benefit from acoustic hearing aids. Other types of hearing prostheses, such as cochlear implants and middle ear implants, can be a suitable alternative for individuals.

SUMMARY

In an exemplary embodiment, there is an ear hook apparatus, comprising, an ear hook tip, an ear hook chassis, and a male connector, wherein the ear hook apparatus is configured such that the male connector attaches to one or more components of a BTE device at and/or below a base of a BTE electronics module of the BTE device.

In an exemplary embodiment, there is a behind-the-ear (BTE) device, comprising, a BTE electronics module, and an ear interface, wherein the ear interface is operationally removable from the BTE electronics module, the ear interface includes a portion configured to extend in front of a pinna when the BTE device is worn behind the ear, and the ear interface is safety connected to the BTE electronics module.

In an exemplary embodiment, there is a method, comprising obtaining a behind-the-ear (BTE) assembly including a BTE electronics module, obtaining an ear interface, placing the ear interface against the BTE electronics module such that a portion of the interface extends into an area of the behind-the-ear assembly, and locking the ear interface to the BTE assembly via the portion extending into the area of the BTE assembly.

BRIEF DESCRIPTION OF THE DRAWINGS

Embodiments of the present invention are described below with reference to the attached drawings, in which.

DETAILED DESCRIPTION

The teachings detailed herein can be used as part of a BTE device or a device that includes a connector that is part of a partially implantable or a totally implantable cochlear implant. It is noted that in alternate embodiments, the teachings detailed herein and/or variations thereof can be applicable to other types of hearing prostheses, such as, for example, bone conduction devices (e.g., active transcutaneous bone conduction devices, passive transcutaneous bone conduction devices, and percutaneous bone conduction devices), Direct Acoustic Cochlear Implant (DACI), middle ear implants, etc. Embodiments can include any type of hearing prosthesis that can utilize the teachings detailed herein and/or variations thereof. It is further noted that in some embodiments, the teachings detailed herein and/or variations thereof can be utilized in other types of prostheses beyond hearing prostheses. Thus, any disclosure herein corresponds to a disclosure of such used with/in any of the aforementioned devices.

Figure 1:
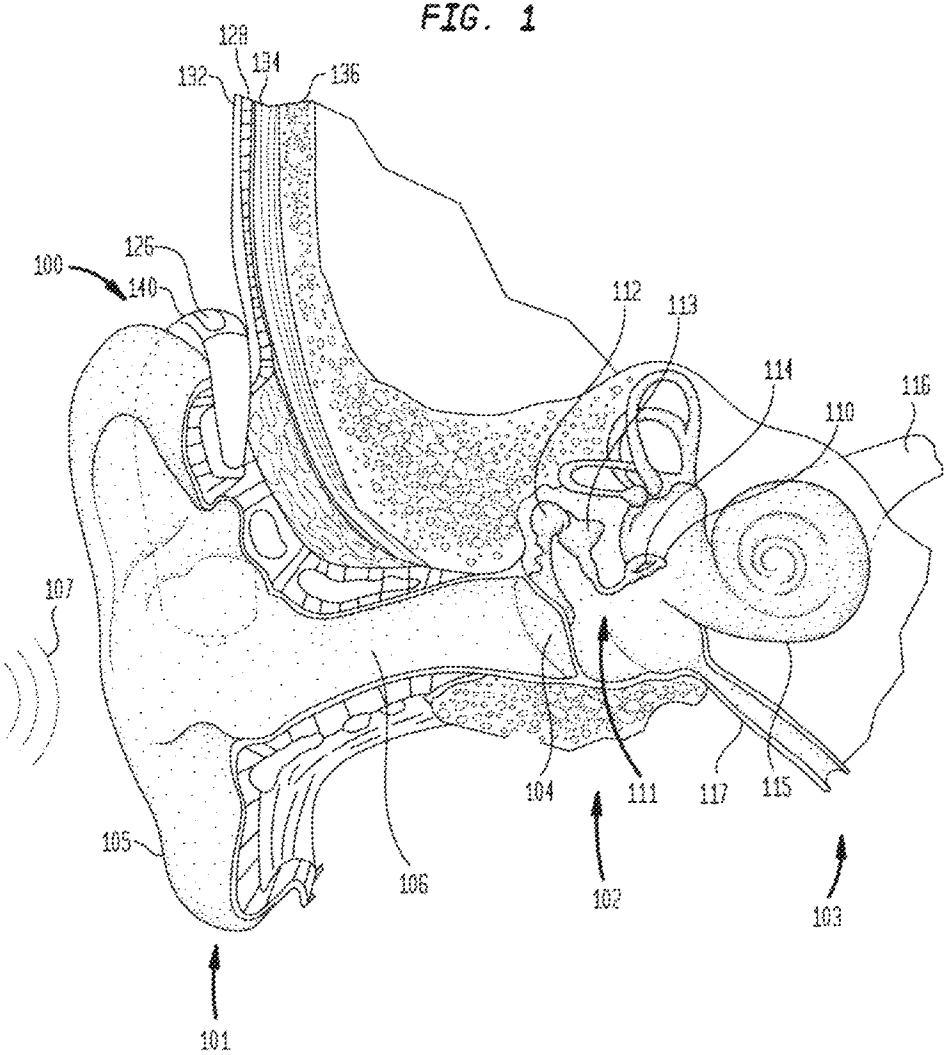
FIG. 1 is a perspective view of an exemplary bone conduction device in which embodiments of the present invention can be implemented.

FIG. 1 is a perspective view of a passive transcutaneous bone conduction device 100 in which embodiments of the present invention can be implemented, worn by a recipient. As shown, the recipient has an outer ear 101, a middle ear 102, and an inner ear 103. Elements of outer ear 101, middle ear 102, and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113, and the stapes 114. The ossicles 111 of middle ear 102 serve to filter and amplify acoustic wave 107, causing oval window 110 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102, and inner ear 103 of a recipient of device 100. As shown, bone conduction device 100 is positioned behind outer ear 101 of the recipient. Bone conduction device 100 comprises an external component 140 in the form of a behind-the-ear (BTE) device.

External component 140 typically comprises one or more sound input elements 126, such as a microphone, for detecting and capturing sound, a sound processing unit/sound processor (not shown) and a power source (not shown). The external component 140 includes an actuator (not shown), which in the embodiment of FIG. 1, is located within the body of the BTE device, although in other embodiments, the actuator can be located remote from the BTE device (or other components of the external component 140 having a sound input element, a sound processing unit and/or a power source, etc.).

It is noted that sound input element 126 can comprise, for example, devices other than a microphone, such as, for example, a telecoil, etc. In an exemplary embodiment, sound input element 126 can be located remote from the BTE device and can take the form of a microphone or the like located on a cable or can take the form of a tube extending from the BTE device, etc. Alternatively, sound input element 126 can be subcutaneously implanted in the recipient, or positioned in the recipient's ear. Sound input element 126 can also be a component that receives an electronic signal indicative of sound, such as, for example, from an external audio device. For example, sound input element 126 can receive a sound signal in the form of an electrical signal from an MP3 player electronically connected to sound input element 126.

The sound processing unit/sound processor of the external component 140 processes the output of the sound input element 126, which is typically in the form of an electrical signal. The processing unit generates control signals that cause the actuator to vibrate. In other words, the actuator converts the electrical signals into mechanical vibrations for delivery to the recipient's skull.

As noted above, with respect to the embodiment of FIG. 1, bone conduction device 100 is a passive transcutaneous bone conduction device. That is, no active components, such as the actuator, are implanted beneath the recipient's skin 132. In such an arrangement, as will be described below, the active actuator is located in external component 140.

The embodiment of FIG. 1 is depicted as having no implantable component. That is, vibrations generated by the actuator are transferred from the actuator, into the skin directly from the actuator and/or through a housing of the BTE device, through the skin of the recipient, and into the bone of the recipient, thereby evoking a hearing percept without passing through an implantable component. In this regard, it is a totally external or non-surgical bone conduction device. Alternatively, in an exemplary embodiment, there is an implantable component that includes a plate or other applicable component, as will be discussed in greater detail below. The plate or other component of the implantable component vibrates in response to vibration transmitted through the skin.

Figure 2A:
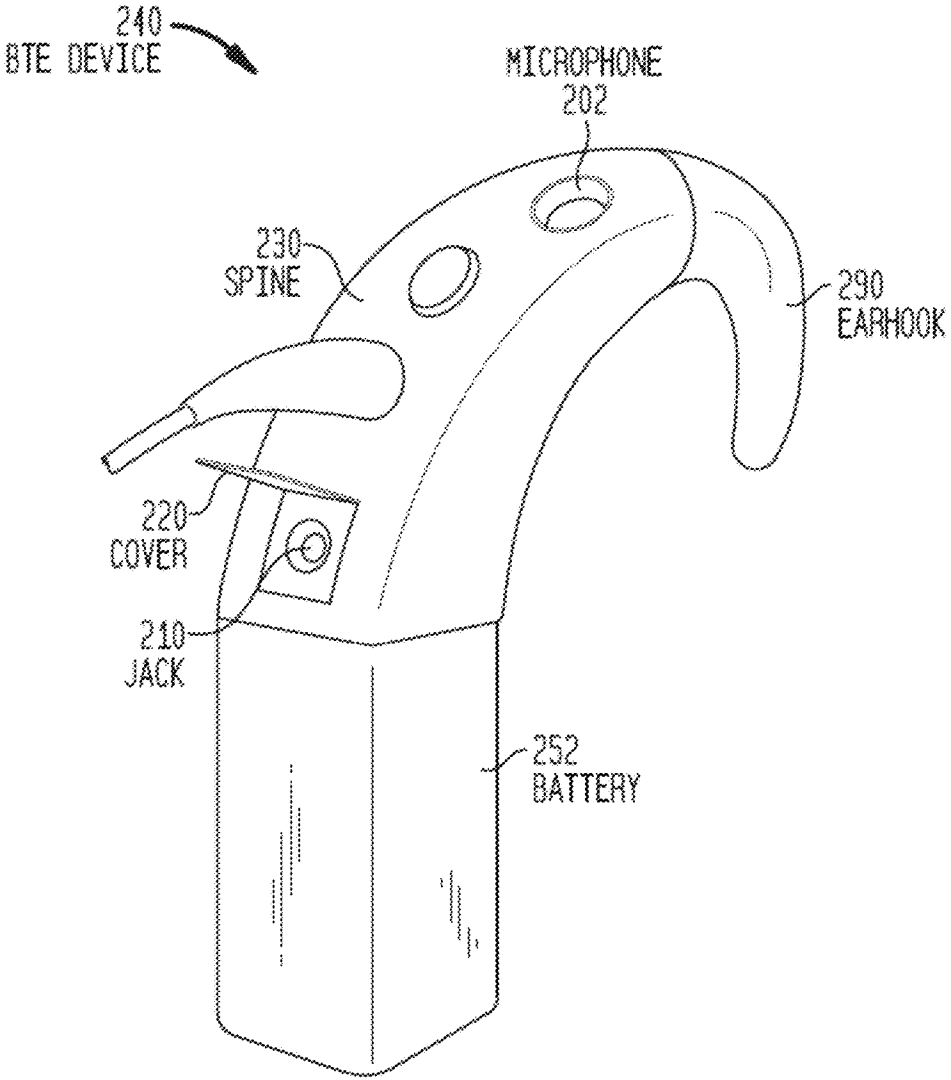
FIG. 2A is a perspective view of a Behind-The-Ear (BTE) device according to an exemplary embodiment.

FIG. 2A is a perspective view of a BTE device 240 of a hearing prosthesis, which, in this exemplary embodiment, corresponds to the BTE device (external component 140) detailed above with respect to FIG. 1. BTE device 240 includes one or more microphones 202, and may further include an audio signal jack 210 under a cover 220 on the BTE electronics module (sometimes referred to in the art and herein as a spine or sound processor or sound processor sub-assembly) 230 of BTE device 240. It is noted that in some other embodiments, one or both of these components (microphone 202 and/or jack 210) may be located on other positions of the BTE device 240, such as, for example, the side of the BTE electronics module 230 (as opposed to the back of the BTE electronics module 230, as depicted in FIG. 2), the ear hook 290, etc. FIG. 2A further depicts battery 252 and ear hook 290 removably attached to BTE electronics module 230.

Figure 2B:
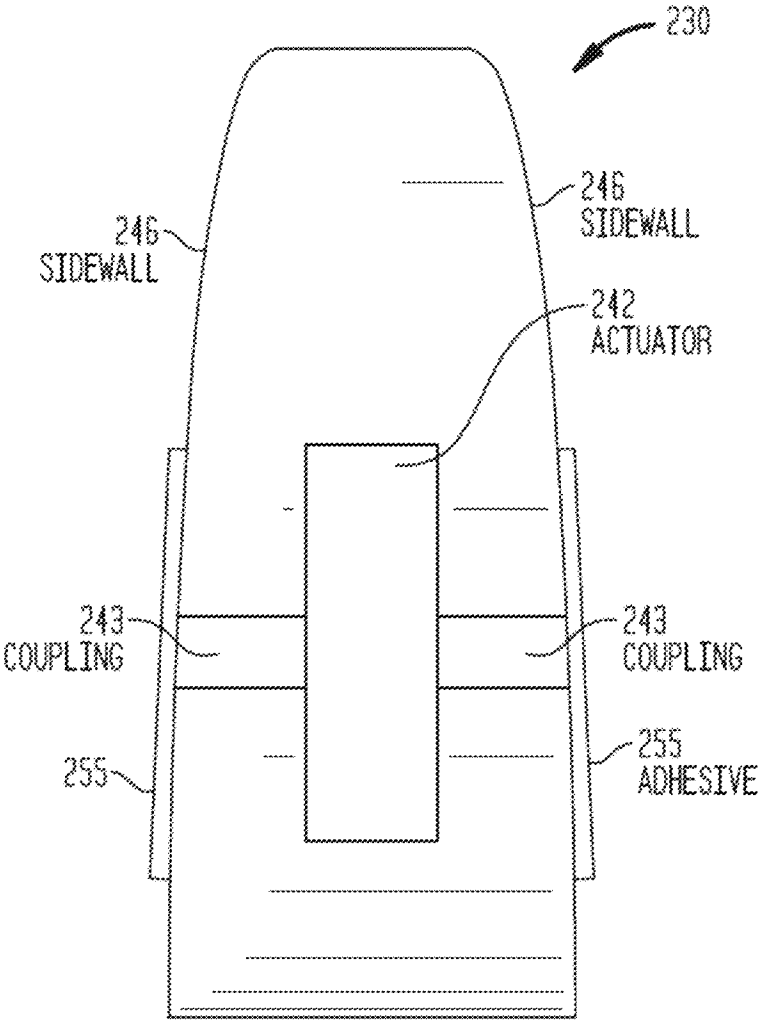
FIG. 2B is a cross-sectional view of a BTE electronics module (sometimes referred to in the art as a spine) of the BTE device of FIG. 2A.

FIG. 2B is a cross-sectional view of an exemplary BTE electronics module 230 of BTE device 240 of FIG. 2A. Actuator 242 is shown located within the BTE electronics module 230 of BTE device 242. Actuator 242 is a vibrator actuator, and is coupled to the sidewalls 246 of the BTE electronics module 230 via couplings 243 which are configured to transfer vibrations generated by actuator 242 to the sidewalls 246, from which those vibrations are transferred to skin 132. In an exemplary embodiment, couplings 543 are rigid structures having utilitarian vibrational transfer characteristics. The sidewalls 246 form at least part of a housing of BTE electronics module 230. In some embodiments, the housing hermetically seals the interior of the BTE electronics module 230 from the external environment.

In the embodiment of FIGS. 2A and 2B, the BTE device 240 forms a self-contained transcutaneous bone conduction device. It is a passive transcutaneous bone conduction device in that the actuator 242 is located external to the recipient.

FIG. 2B depicts adhesives 255 located on the sidewalls 246 of the BTE device 240. As will be detailed below, adhesives 255 form coupling portions that are respectively configured to removably adhere the BTE device 240 to the recipient via adhesion at the locations of the adhesives 255. This adherence being in addition to that which might be provided by the presence of the ear hook 290 and/or any grasping phenomenon resulting from the auricle 105 of the outer ear and the skin overlying the mastoid bone of the recipient. Accordingly, in an exemplary embodiment, there is an external component, such as a BTE device, that includes a coupling portion that includes a surface configured to directly contact the outer skin. This coupling portion is configured to removably attach the external component to an outer surface of skin of the recipient via attraction of the contact surface to the respective contact portion of the outer skin.

It is noted that the embodiment of FIG. 2B is depicted with adhesives 255 located on both sides of the BTE device. In an exemplary embodiment of this embodiment, this permits the adherence properties detailed herein, and/or variations thereof, to be achieved regardless of whether the recipient wears the BTE device on the right side (in accordance with that depicted in FIG. 1) or the left side (or wears two BTE devices). In an alternate embodiment, BTE device 240 includes adhesive only on one side (the side appropriate for the side on which the recipient intends to wear the BTE device 240). An embodiment of a BTE device includes a dual-side compatible BTE bone conduction device, as will be detailed below.

The adhesives 255 are depicted in FIG. 2B in an exaggerated manner so as to be more easily identified. In an exemplary embodiment, the adhesives 255 are double sided tape, where one side of the tape is protected by a barrier, such as a silicone paper, that is removed from the skin-side of the double-sided tape in relatively close temporal proximity to the placement of the BTE device 240 on the recipient. In an exemplary embodiment, adhesives 255 are glue or the like. In an exemplary embodiment where the adhesives 255 are glue, the glue can be applied in relatively close temporal proximity to the placement of the BTE device 240 on the recipient. Such application can be applied by the recipient to the BTE electronics module 230, in an exemplary embodiment.

In an alternate embodiment, the adhesives 255 are of a configuration where the adhesive has relatively minimal adhesive properties during a temporal period when exposed to some conditions, and has relatively effective adhesive properties during a temporal period, such as a latter temporal period, when exposed to other conditions. Such a configuration can provide the recipient control over the adhesive properties of the adhesives.

By way of example, the glue and/or tape (double-sided or otherwise) may be a substance that obtains relatively effective adhesive properties when exposed to oil(s) and/or sweat produced by skin, when exposed to a certain amount of pressure, when exposed to body heat, etc., and/or a combination thereof and/or any other phenomena that may enable the teachings detailed herein and/or variations thereof to be practiced. Such exemplary phenomena may be, for example, heat generated via friction resulting from the recipient rubbing his or her finger across the glue. In an exemplary embodiment, the pressure can be a pressure above that which may be expected to be experienced during normal handling of the BTE electronics module 230.

In an exemplary embodiment, the adhesives 255 are contained in respective containers that exude glue or the like when exposed to certain conditions, such as by way of example and not by way of limitation, the aforementioned conditions. Alternatively, and/or in addition to this, the recipient may puncture or otherwise open the containers to exude the glue or the like.

Any device, system, and/or method that will enable a recipient to practice the teachings detailed herein and/or variations thereof associated with the adherence of the bone conduction device to skin of the recipient for vibration transmission can be utilized in some embodiments.

In an exemplary embodiment, the vibrator actuator 242 is a device that converts electrical signals into vibration. In operation, sound input element 202 converts sound into electrical signals. Specifically, these signals are provided to vibrator actuator 242, or to a sound processor (not shown) that processes the electrical signals, and then provides those processed signals to vibrator actuator 242. The vibrator actuator 242 converts the electrical signals (processed or unprocessed) into vibrations. Because vibrator actuator 242 is mechanically coupled to sidewalls 246, the vibrations are transferred from the vibrator actuator 342 to skin 132 of the recipient.

Figure 2C:
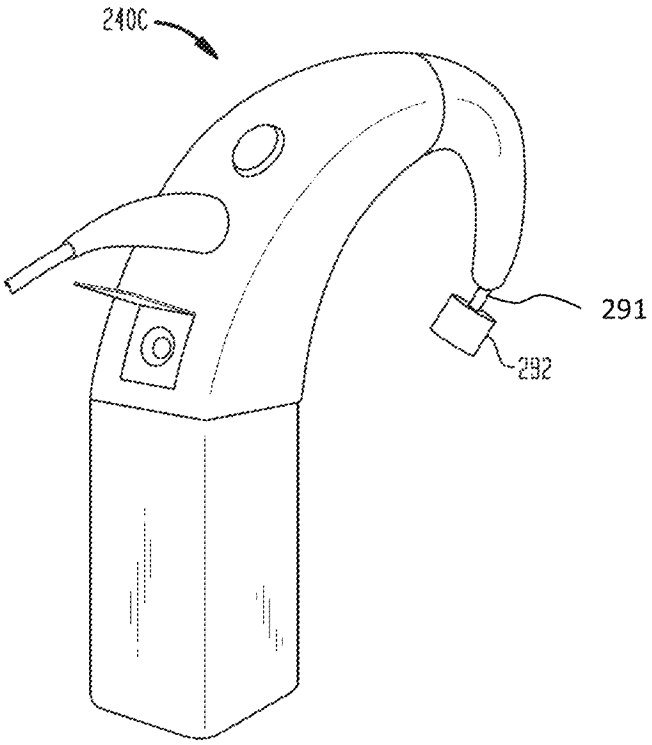
FIG. 2C is a perspective view of an alternate embodiment of a BTE device.

FIG. 2A depicts the sound input element 202 as being located at about the apex of BTE electronics module 230. FIG. 2C depicts an alternate embodiment of a BTE device 240C in which the sound input element 292 is mounted on a stem 291 extending from the ear hook 290. In an exemplary embodiment, the stem 291 is such that during normal use, the sound input element 292 is located below the ear, in the area of the auricular concha, or in the ear canal. Such a configuration can have utilitarian value by way of reducing feedback as compared to that which may result from the embodiment of FIG. 2A.

Figure 3A:
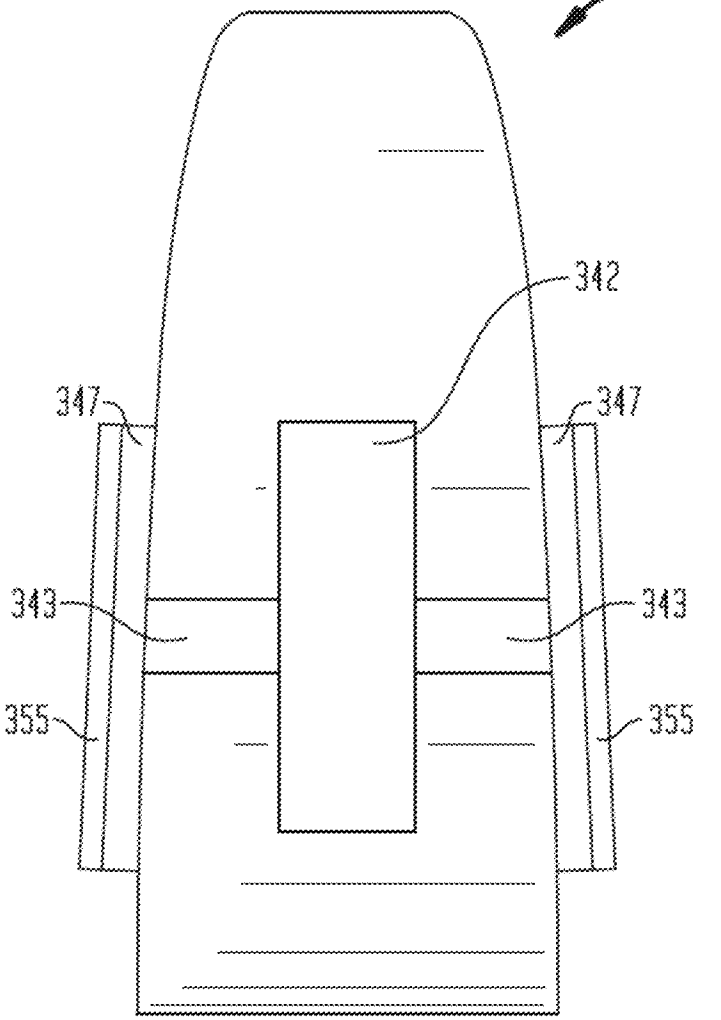
FIG. 3A is a cross-sectional view of a BTE electronics module (sometimes referred to in the art as a spine) of a BTE device according to an alternate embodiment.

It is noted that while the embodiments depicted in FIGS. 2A and 2B detail the vibrations being transferred from the vibrator actuator 242 to the sidewalls 246 via the couplings 243, in other embodiments, the vibrations are transferred to plates or other devices that are located outside of the sidewalls 246. FIG. 3A depicts such an exemplary embodiment, where BTE electronics module 330A includes couplings 343 extending through sidewalls 346 to plates 347, on which adhesives 355 are located.

Figure 3B:
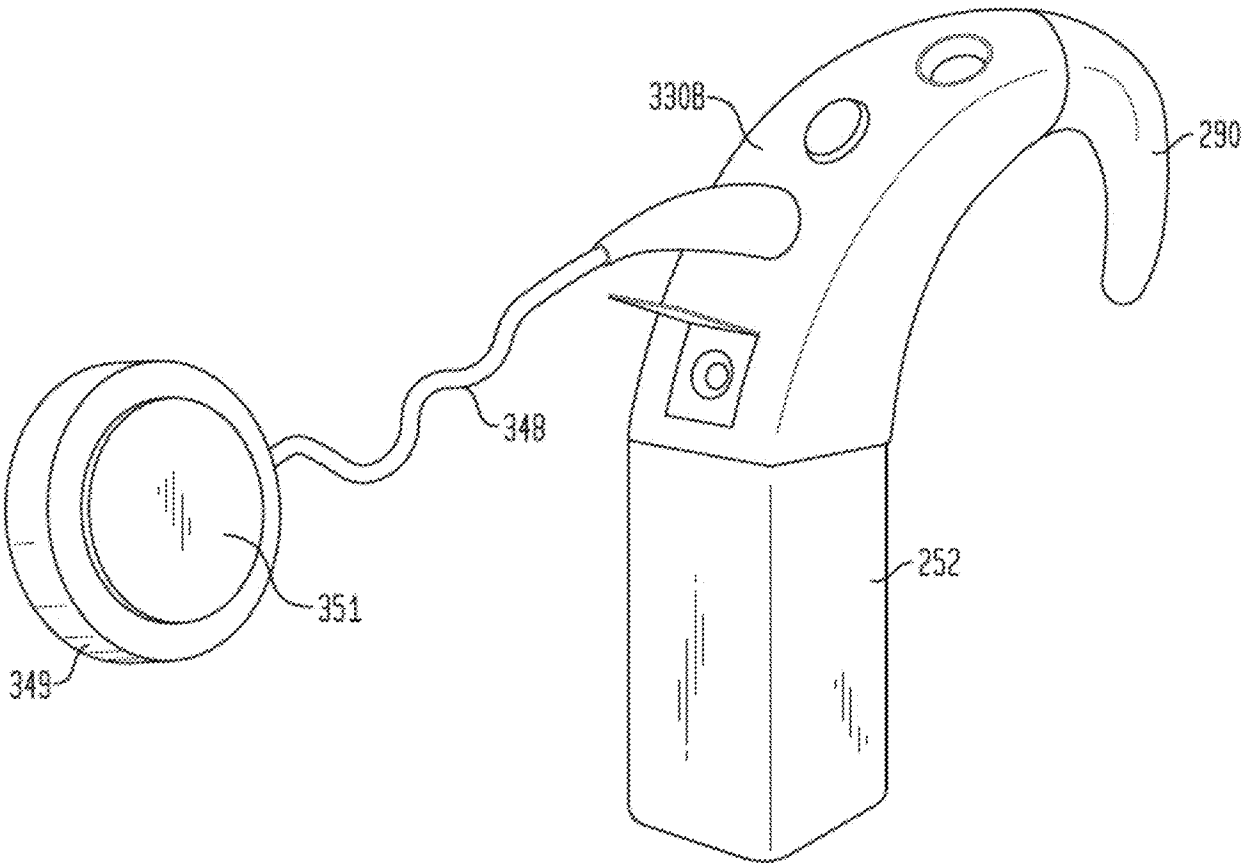
FIG. 3B is a perspective view of an alternate embodiment of an external device including a BTE device.

FIG. 3B depicts an alternate embodiment of an external component of a bone conduction device, BTE device 340, in which the vibrator actuator (such as actuator 242 detailed above, or a variation thereof) is located in a remote vibrator actuator unit 349 (sometimes referred to as a "button" in the art). This as opposed to the BTE electronics module 330B. Vibrator actuator unit 349 is in electronic communication with BTE electronics module 330B via cable 348. BTE electronics module 330B functionally corresponds to the BTE electronics modules detailed above, with the exception of the features associated with containing a vibrator actuator therein. In this regard, electrical signals are transferred to the vibrator actuator in vibrator actuator unit 349, these signals being, in some embodiments, the same as those which are provided to the other vibrator actuators detailed herein. Vibrator actuator unit 349 may include a coupling 351 to removably attach the unit 349 to outer skin of the recipient. Coupling 351 can correspond to the couplings detailed herein. Such a coupling may include, for example, adhesive. Alternatively, and/or in addition to this, coupling 351 can correspond to a magnet that couples via magnetic attraction to an implanted magnet within the recipient (e.g., an implanted magnet attached to the mastoid bone of the recipient underneath the skin of the recipient).

Such a configuration as that of BTE device 340, can have utilitarian value by way of reducing feedback as compared to that which may result from the embodiment of FIG. 2A.

While the embodiment depicted in FIG. 3B utilizes a cable 348 to communicate with the remote vibrator actuator unit 349, in an alternative embodiment, a wireless link is utilized to communicate between the spine 330B and the remote vibrator actuator unit 349.

In at least some exemplary embodiments, the remote vibrator actuator unit 349 can contain a sound processor/sound processing unit or the like as opposed to, and/or in addition to, the BTE electronics module 330B. Accordingly, in an exemplary embodiment, the remote vibrator actuator unit 349 can be a button sound processor, where, in at least some embodiments, the functionality of the BTE device vis-à-vis sound capture and/or signal processing and/or power is instead present in the button sound processor, enabling, in at least some exemplary embodiments, the BTE device to be done away with.

It is noted that while the embodiment of FIG. 3B depicts the microphone being located on the BTE electronics module 330B at about the apex thereof, in an alternate embodiment, the microphone can be located in a manner corresponding to that of FIG. 2C. It is further noted that the microphone can be located on the ear hook 290 anywhere from and including the tip thereof to the location where the ear hook interfaces with the BTE electronics module. Such is also the case with respect to the microphone located on the BTE electronics module 330B—the microphone can be located anywhere on the BTE electronics module from the interface of the BTE electronics module in the ear hook 290 to the interface of the battery 252 with the BTE electronics module 330B. Still further, as noted above, BTE device 340 can include a plurality of microphones located according to the various teachings detailed herein and/or variations thereof. In this regard, the aforementioned locations of the various microphones are applicable to the other embodiments detailed herein, such as by way of example, the embodiment of FIG. 2A, along with the embodiments that will be detailed below. Any microphone placement that can enable the teachings detailed herein and/or variations thereof to be practiced can be utilized in at least some exemplary embodiments.

In some exemplary embodiments, any device, system, and/or method that will enable the teachings detailed herein and/or variations thereof associated with vibration transmission from the actuator to the skin and/or to bone of the recipient may be utilized.

It is briefly noted that in an exemplary embodiment, the arrangement of FIG. 3B can instead be that of a cochlear implant external component/removable component, or a middle ear implant external component/removable component, or an active transcutaneous bone conduction device external component/removable component, where element 349 is an RF inductance coil that transcutaneously communicates via inductance with an implanted RF inductance coil that is in signal communication with a stimulator when actuator alike of the implantable component.

Some additional embodiments of some exemplary embodiments will now be described.

Figure 4:
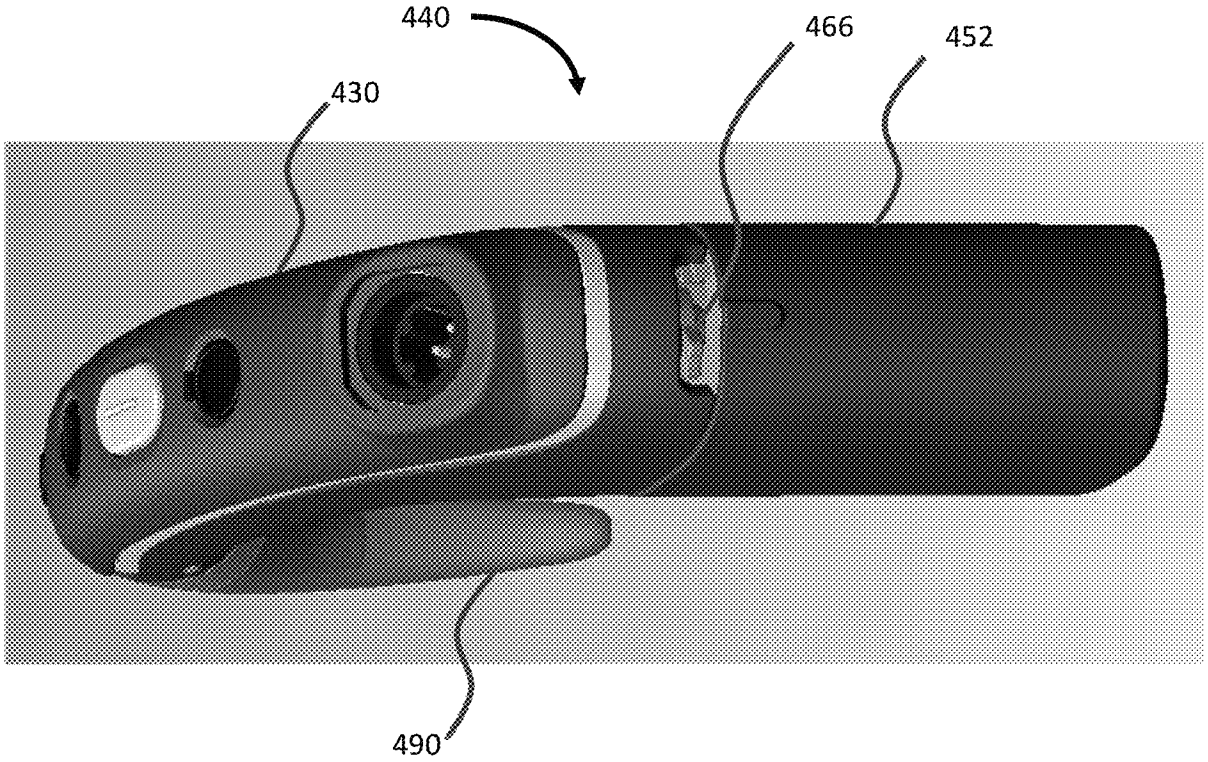
FIG. 4 is a perspective view of an alternate embodiment of a BTE device.

FIG. 4 depicts an exemplary BTE device 440 according to an exemplary embodiment. As seen BTE device 440 includes element 430, which functionally and structurally can correspond to element 330B above, and thus corresponds to the BTE electronics module of the BTE device. However, hereinafter, element 440 will be referred to by its more generic name as the signal processor sub-assembly, or sometimes the electronics component of the BTE device, or sometimes, for short, the signal processor. As can be seen, attached thereto is an element 452 which corresponds to element 252 above, and thus corresponds to a power component of the BTE device, which in some instances herein will be referred to as the battery sub-assembly, or the battery for short. Element 490 is an ear hook, and corresponds to element 290 above. The battery sub-assembly 452 is removably attached to the BTE electronics module, which here, is a sound processor sub-assembly 430 via a bayonet connector, the details of which will be described below. Latch 466 enables the recipient to unlock and lock the battery sub-assembly 452 from and to, respectively, the sound processor sub-assembly 430, via moving the handle of the latch 466 from one side of the BTE device 440 to the other side of the BTE device 440. In an exemplary embodiment, the ear hook 490 is a 70 Shore A, LSR KE-2093 overmolded body, or a separately molded body, or formed by any utilitarian manner enabled by the art that attaches permanently or removably to the BTE electronics module (e.g., by a snap coupling or an interference fit, etc.). In an exemplary embodiment, the ear hook 490 has a hardness of between 5 to 90 (inclusive, as is the case with respect to all ranges detailed herein unless otherwise noted) Shore A, and can have any value or range of values therebetween in about one increment. Any type of liquid silicone rubber material that can have utilitarian value can be utilized in at least some exemplary embodiments to make the ear hook 490.

Figure 5:
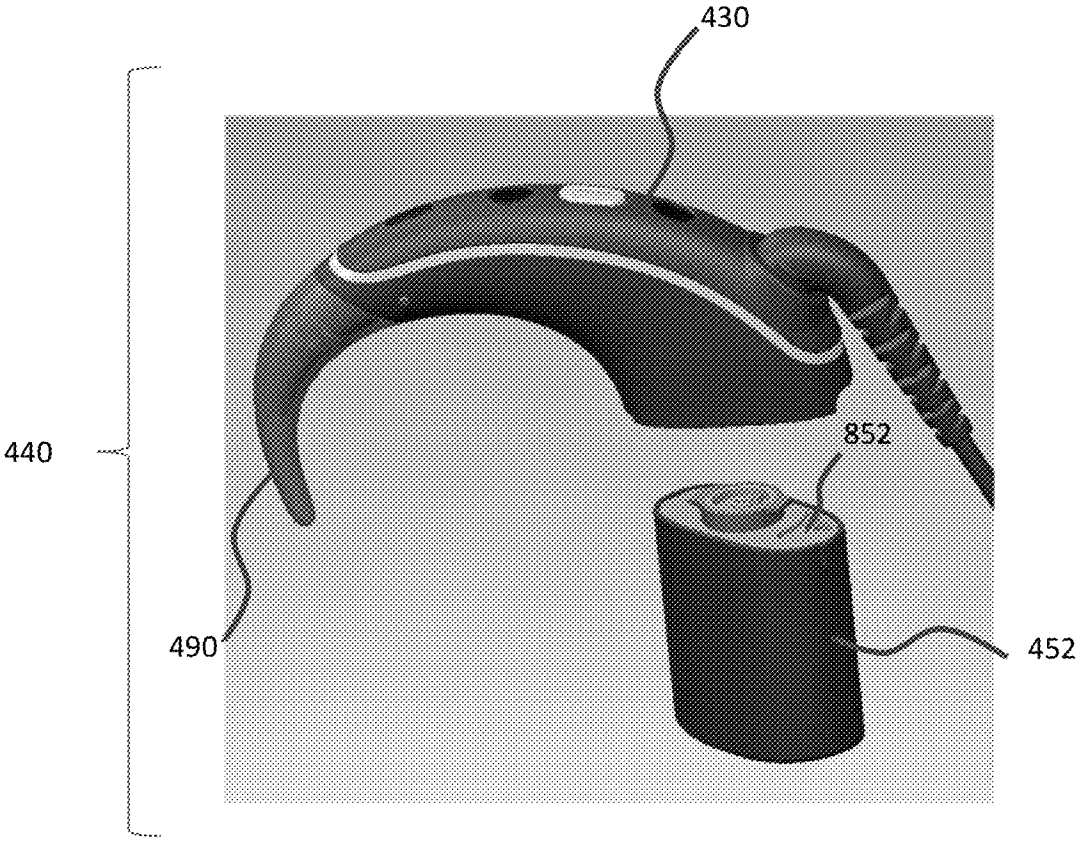
FIGS. 5, 6, and 7 are perspective views of attachment of a battery sub-assembly to a sound processor sub-assembly (another name in the art for a specific species of the genus of BTE electronics module) according to an exemplary embodiment.

FIG. 5 depicts the sound processor sub-assembly 430 and components connected thereto decoupled or otherwise unattached to the battery sub-assembly 452. The plug assembly 852 can be seen as part of the battery sub-assembly 452, which plug assembly interfaces with a corresponding socket assembly (not viewable in FIG. 5) of the electronics component 430 of the BTE device.

Figure 6:
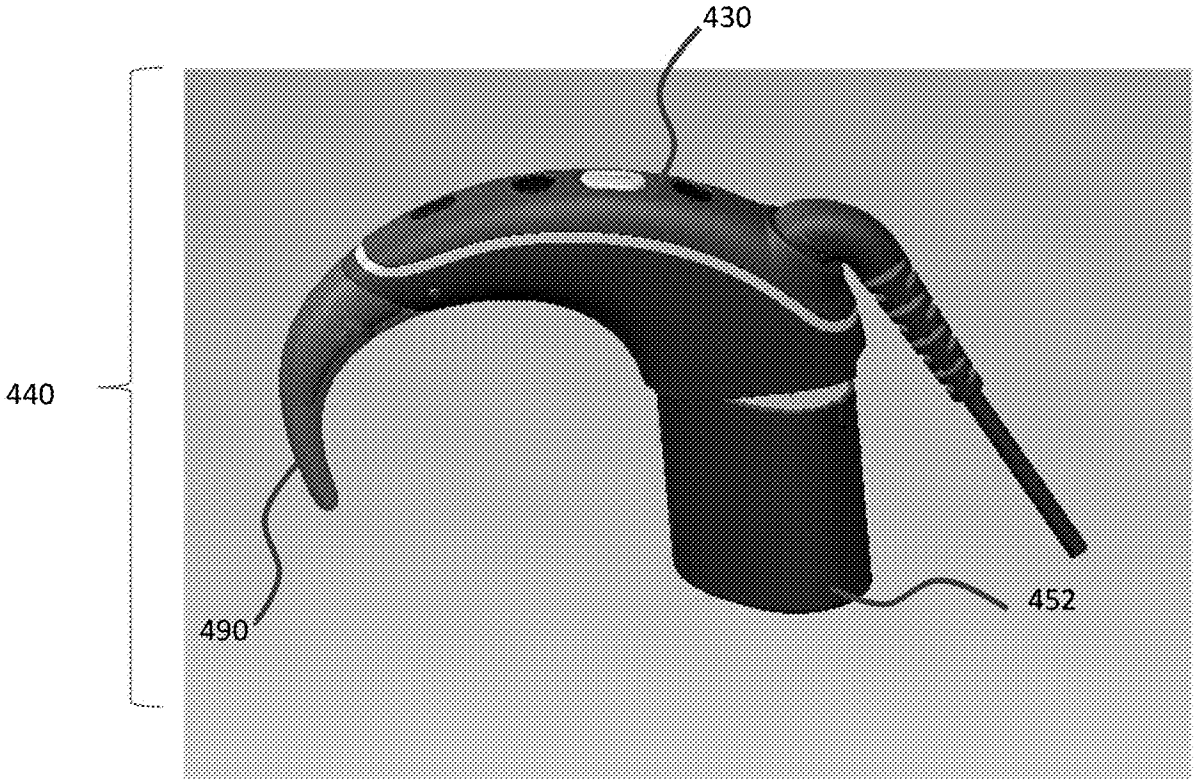
Figure 7:
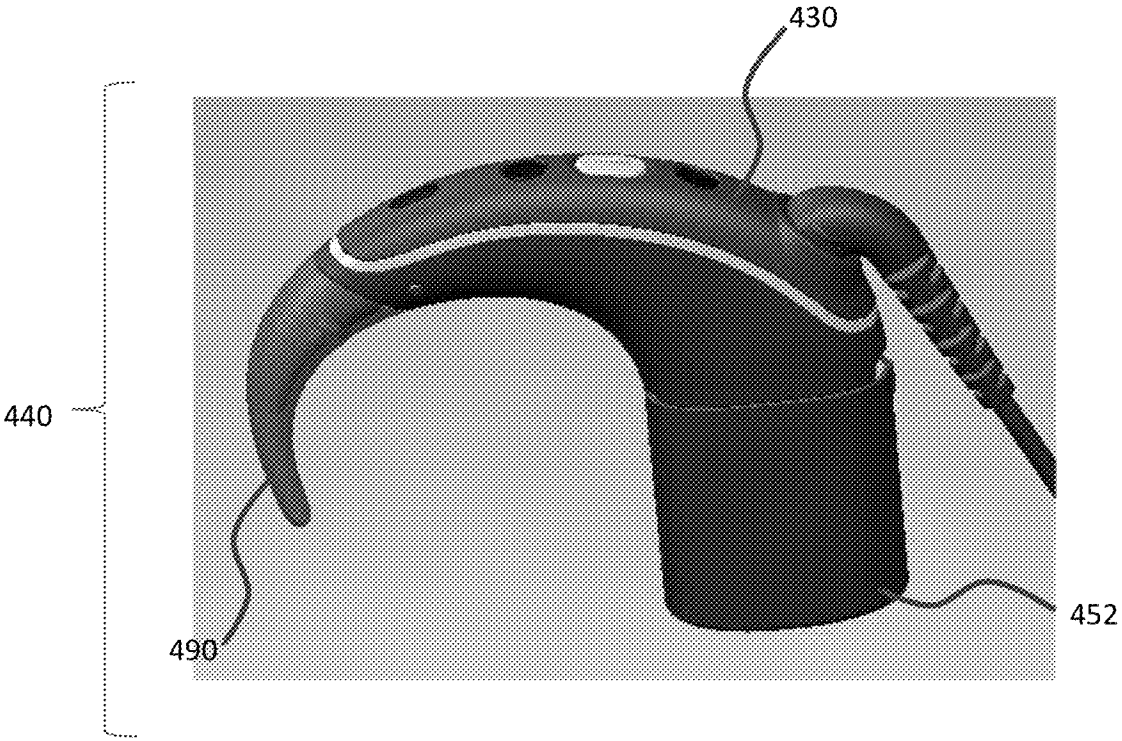

In an exemplary embodiment of attachment of the battery sub-assembly 452 to the sound processor sub-assembly 430, a recipient grasps the respective components with his or her left-hand and right-hand respectively, or vice versa, and moves the battery assembly 452 towards the sound processor sub-assembly 430, with the battery sub-assembly 452 canted about the longitudinal axis thereof relative to its final orientation when fully and completely attached to the sound processor sub-assembly 430. FIG. 6 depicts the battery sub-assembly 452 in contact with the sound processor sub-assembly 430 with some rotation about the longitudinal axis of the battery sub-assembly relative to that which is the case shown in FIG. 5. In an exemplary embodiment, this rotation engages the bayonet fittings to attach the battery sub-assembly 452 to the sound processor sub-assembly 430, as will be described in greater detail below. FIG. 7 depicts the battery sub-assembly 452 fully rotated about its longitudinal axis so as to fully connect or otherwise seat the battery sub-assembly 452 to/against the sound processor assembly 430. Subsequent this action, as noted above, the latch 466 is moved so as to lock the battery sub-assembly 452 to the sound processor sub-assembly 430. In an exemplary embodiment, to remove the battery sub-assembly 452 from the sound processor sub-assembly 430, the latch 466 is moved so as to unlock the components and then the battery sub-assembly 452 is rotated about its longitudinal axis so as to undo the bayonet fitting, and then put downward in the direction of its longitudinal axis, away from the sound processor sub-assembly 430, and thus decoupling the battery sub-assembly 452 from the sound processor sub-assembly 430.

Figure 8:
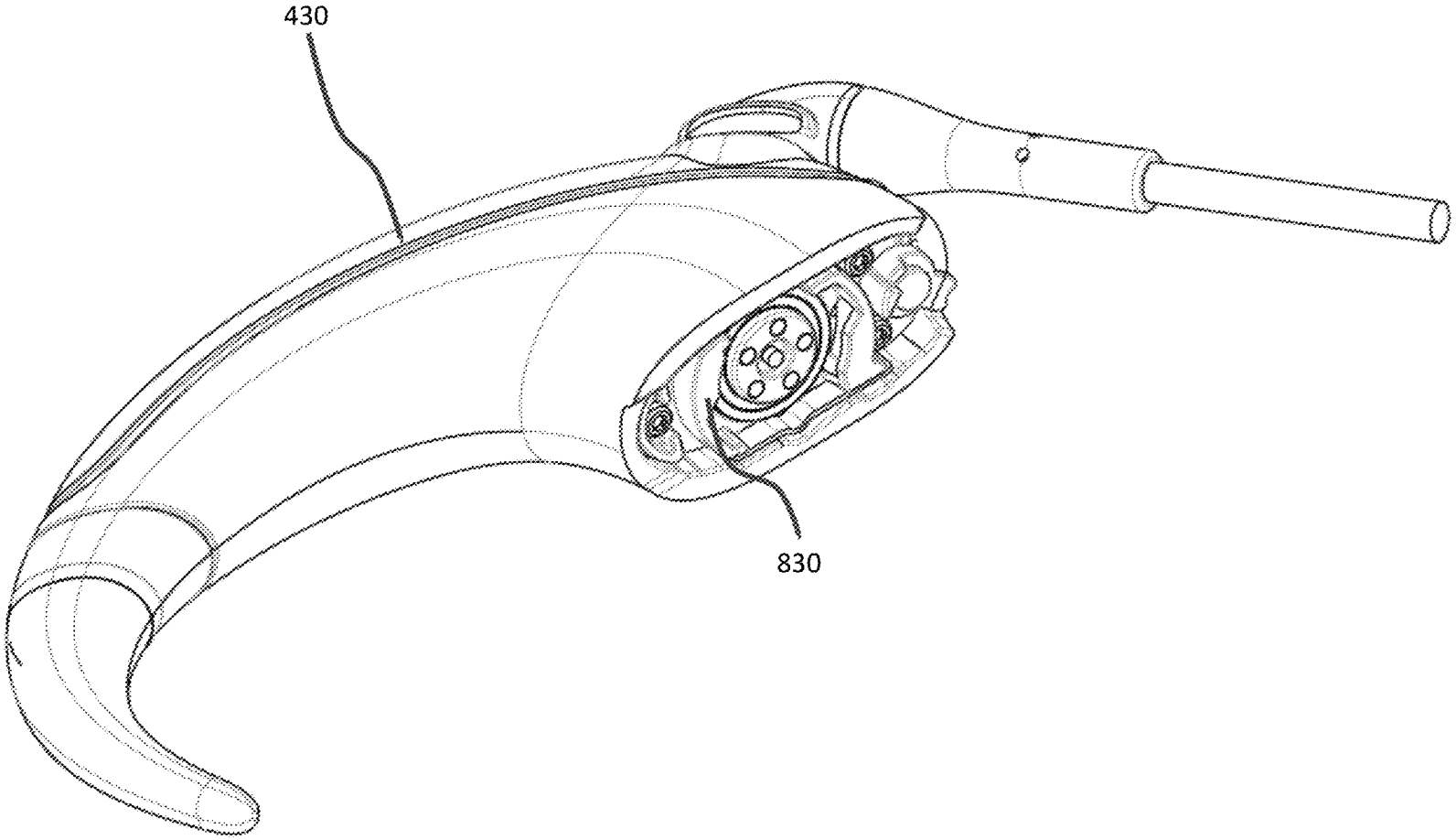
FIG. 8 is a bottom perspective view of a sound processor sub-assembly according to an exemplary embodiment.
Figure 9:
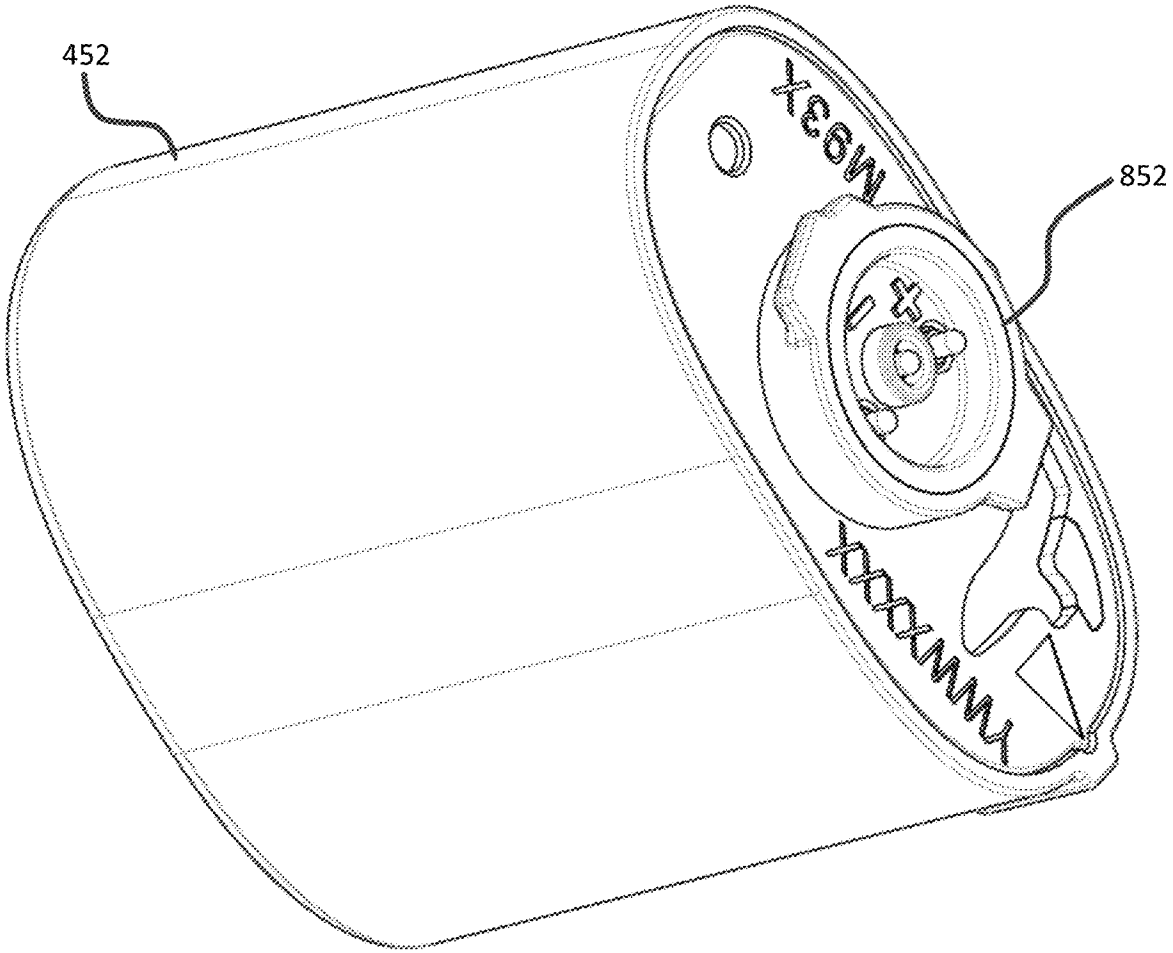
FIG. 9 is a top perspective view of a battery subassembly according to an exemplary embodiment.
Figure 10:
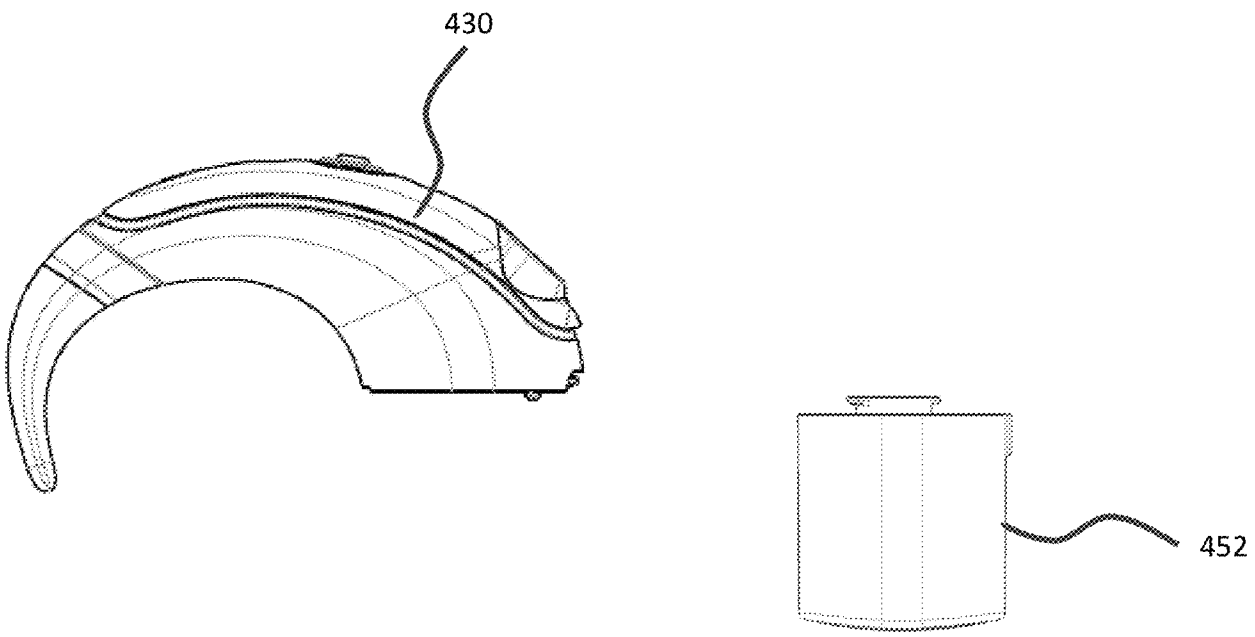
FIGS. 10, 11, and 12 schematically depict an alternate configuration where the battery sub-assembly is laterally moved to connect to the sound processor sub-assembly.
Figure 11:
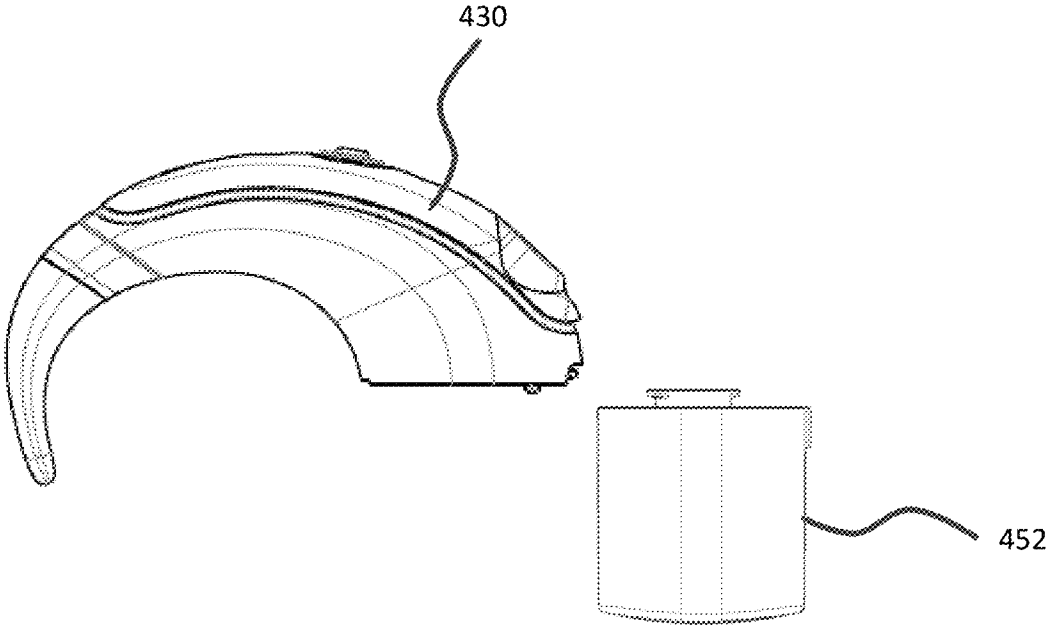

FIG. 8 depicts an isometric bottom view of the sound processor sub-assembly 430 which enables a view of the socket assembly 830 thereof. FIG. 9 depicts an isometric top view of the battery sub-assembly 452 which depicts the plug assembly 852 thereof. As noted above, the plug 852 and the socket 830 respectively cooperate to form a bayonet coupling/bayonet connector. FIGS. 10 and 11 respectively depict the socket assembly 830 and the plug assembly 852 in isolation from the rest of the sound processor sub-assembly and the battery sub-assembly.

Figure 12:
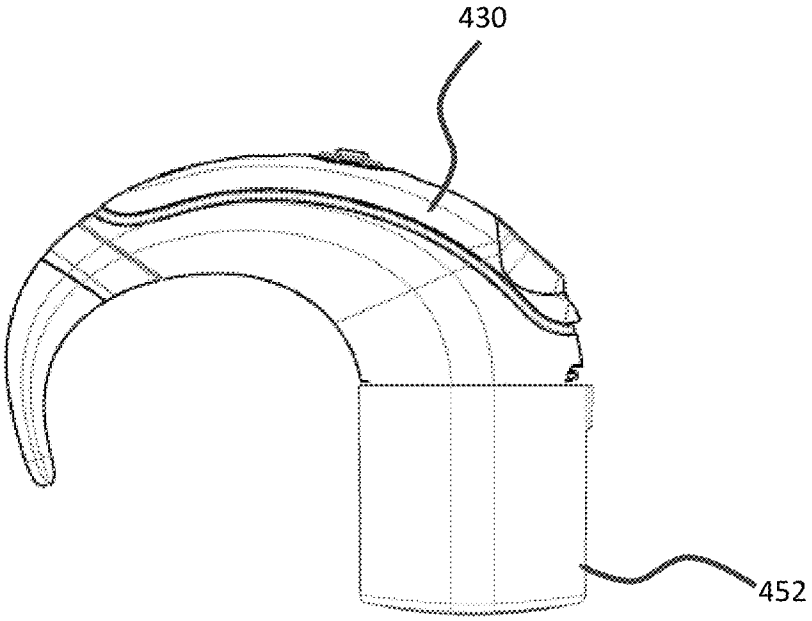

It is also noted that while the embodiments detailed above have focused on the male portion of the bayonet coupling being on the battery subassembly and the female portion of the bayonet coupling being on the sound processor subassembly, in some alternate embodiments, the reverse is the case. That is, the female portion of the banner coupling can be located on the battery subassembly, and the male portion of the bayonet coupling can be located one the sound processor subassembly. Any arrangement of any component of the connector assemblies of the battery subassembly and the sound processor subassembly that can have utilitarian value can be utilized in at least some exemplary embodiments. Literally any shape or configuration or dimensioning that can enable the removal and replacement of the battery subassembly from the sound processor subassembly can be utilized. Indeed, while the embodiments above have focused on an arrangement where a bayonet coupling is utilized so that the battery subassembly 452 can be moved in the vertical direction/in the longitudinal direction of the battery subassembly up to the sound processor subassembly 430 and then turned to couple the two subcomponents together in the traditional manner of a bayonet coupling, in an alternative embodiment, such as is schematically illustrated in FIGS. 10, 11, and 12, the battery subassembly 452 is moved in the lateral direction so as to connect to the sound processor subassembly 430, and moved in the opposite direction so as to disconnect from the sound processor subassembly 430. In such an embodiment, in at least some exemplary embodiments, instead of a bayonet coupling, a different type of coupling is utilized, such as a C shape female slotted connector and a male shape T extruded connector, where the head of the T fits into the concave portion of the C in a sliding manner (where the C and the T extend inward and outward of this page). Consistent with the above embodiments, the male portion can be on the battery assembly and the female portion can be on the sound processor subassembly or vice versa. Another type of coupling, such as a snap coupling, can be utilized in at least some alternative embodiments. Any arrangement whatsoever that can enable the battery subassembly to be removably coupled to the sound processor subassembly can be utilized in at least some exemplary embodiments.

Figure 13:
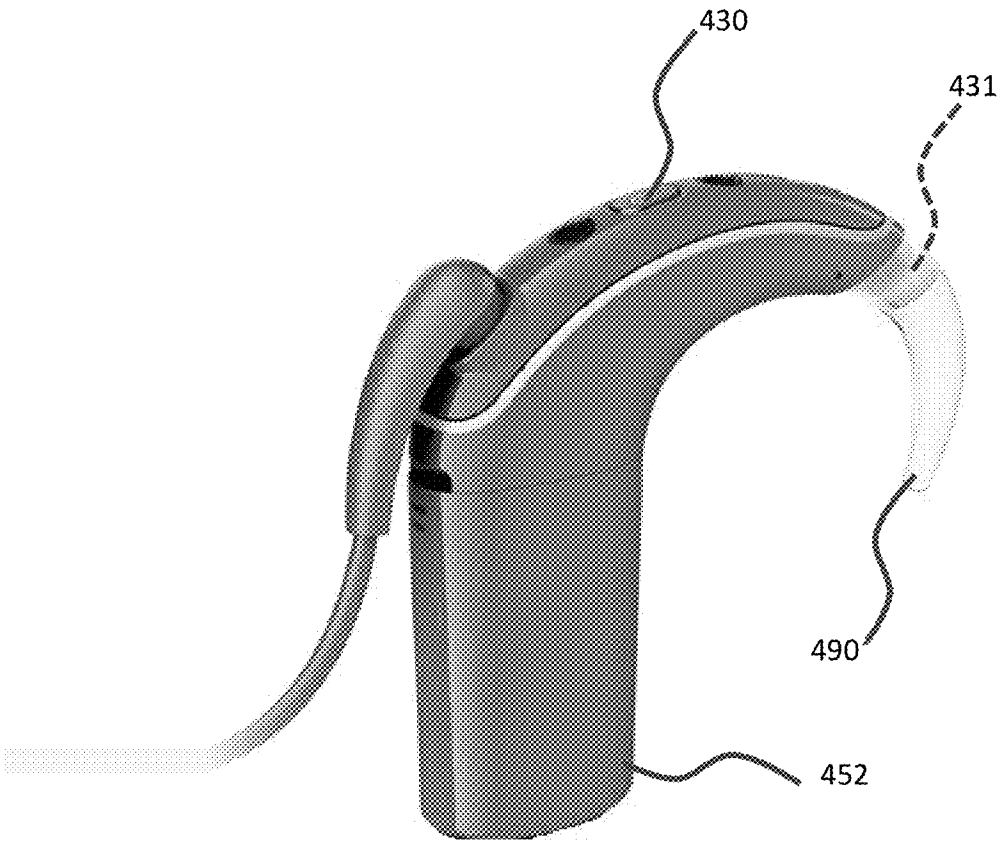
FIG. 13 depicts a BTE device including a transparent ear hook 490.

In at least some exemplary embodiments, there is utilitarian value with respect to the utilization of the ear hook 490. In this regard, in some exemplary embodiments, the ear hook 490 can have utilitarian value with respect to helping to maintain the BTE electronics module 430 on the pinna of the recipient. In at least some exemplary embodiments, there is a male portion of the BTE electronics module 430 at the apex thereof (opposite from the base of the BTE electronics module 430—the location where the battery subassembly 452 interfaces with the BTE electronics module 430) that is enveloped by an ear hook 490 female portion at the base thereof (the portion of the ear hook 490 that interfaces with the body/main body of the BTE electronics module 430). FIG. 13 depicts the male portion 431 of the BTE electronics module 430 (and can also be seen in other figures, such as those discussed below). The male portion 431 can be seen through the transparent/semitransparent material of the ear hook 490 (the male portion 431 can be seen in other figures above as well). In an exemplary embodiment, the male portion has a generally T shaped cross-section, the head/top of the T being opposite the base of the BTE electronics module 430. Conversely, in an exemplary embodiment, the female portion of the ear hook 490 has a C shaped cross-section, the opening of the C facing the base of the ear hook 490/the apex of the BTE electronics module 430. In an exemplary embodiment, the flexible material of the ear hook 490 envelops the male portion 431 such that the tips of the C cross-section fit underneath/behind the top of the T of the cross-section of the male connector 431, thereby retaining the ear hook 490 to the BTE electronics module 430. Some additional details of this will be described in greater detail below.

While the embodiment just described details a flexible or otherwise elastomeric ear hook 490, which can be pushed over the male portion to retain the ear hook thereto, an alternative embodiment, the ear hook 490 is a rigid component that is clipped thereto or snap coupled or molded about the male portion 431. That said, with respect to the embodiments where the ear hook is a flexible component, in some exemplary embodiments, the ear hook 490 is removable from the BTE electronics module 430. Indeed, it is typically readily removable by gripping the ear hook 490 between one's thumb and first finger and then pulling the ear hook away from the BTE electronics module 430. In at least some exemplary embodiments, the ear hook 490 is made of an elastomeric material that readily deforms to slip off of the male portion 431 of the BTE electronics module 430. Conversely, in the absence of this removal force, the ear hook 490 is retained on the BTE electronics module 430, and thus maintains that utility with respect to helping to keep the BTE device 440 on the pinna of the recipient.

It is noted that in at least some exemplary embodiments, the ear hook 490 is a wear component/component that is replaceable because it might wear out. That is, the ear hook will wear out for the useful life of the BTE electronics module 430. In an exemplary embodiment, the BTE electronics module 430 is designed to last for or more than 2, 3, 4, 5, 6, 7, 8, 9, 10, 11, 12, 13, 14, 15, 16, 17, 18, 19, or 20 years or more with respect to standard use (which can have utilitarian value beyond simply providing cost savings with respect to non-replacement, in that the programming and customization of the BTE electronics module 430, such as the species of the sound processor subassembly, to the recipient, need not be done as often because the sound processor will last longer, whereas every time the sound processor is replaced, in at least some exemplary embodiments, a new fitting procedure should be executed). In an exemplary embodiment, the ear hook 490 is designed to last for or less than 70, 65, 60, 55, 50, 45, 40, 35, 30, 25, 20, 19, 18, 17, 16, 15, 14, 13, 12, 11, 10, 9, 8, 7, 6, 5, 4, 3, 2, or 1% or less of the aforementioned temporal periods. Accordingly, there can be utilitarian value with respect to enabling ease of replacement of the ear hook 490 from the BTE electronics module 430.

With respect to embodiments that enable replacement of the ear hook 490 from the BTE electronics module 430, especially embodiments that enable ease of replacement, in at least some exemplary scenarios of use, such can create difficulties. By way of example only and not by way of limitation, in an exemplary embodiment, such as scenarios of use by children, children can sometimes find it pleasurable to pull the ear hook 490. In some exemplary scenarios of use by children, children can sometimes find it pleasurable to remove the ear hook 490 from the BTE electronics module 430. In some exemplary scenarios of use by children, children can sometimes find it pleasurable to chew on the ear hook 490. In some exemplary scenarios of such use, such can have deleterious results with respect to a scenario where the ear hook 490 becomes dislodged from the BTE electronics module 430, in which case a failure mode could occur corresponding to the child swallowing the ear hook 490 or otherwise corresponding to movement of the ear hook 490 from the mouth of the child inward. In at least some exemplary scenarios, this failure mode is undesirable.

Accordingly, in at least some exemplary embodiments, there is an ear hook apparatus that is more difficult to remove from the BTE device subassembly that includes the battery subassembly 452 and the electronics module 430. Hereinafter, this subassembly is referred to as the BTE device operational assembly. In this regard, the BTE device operational assembly includes the BTE electronics module 430 and the battery 452. It does not include the ear hook 490.

Figure 14:
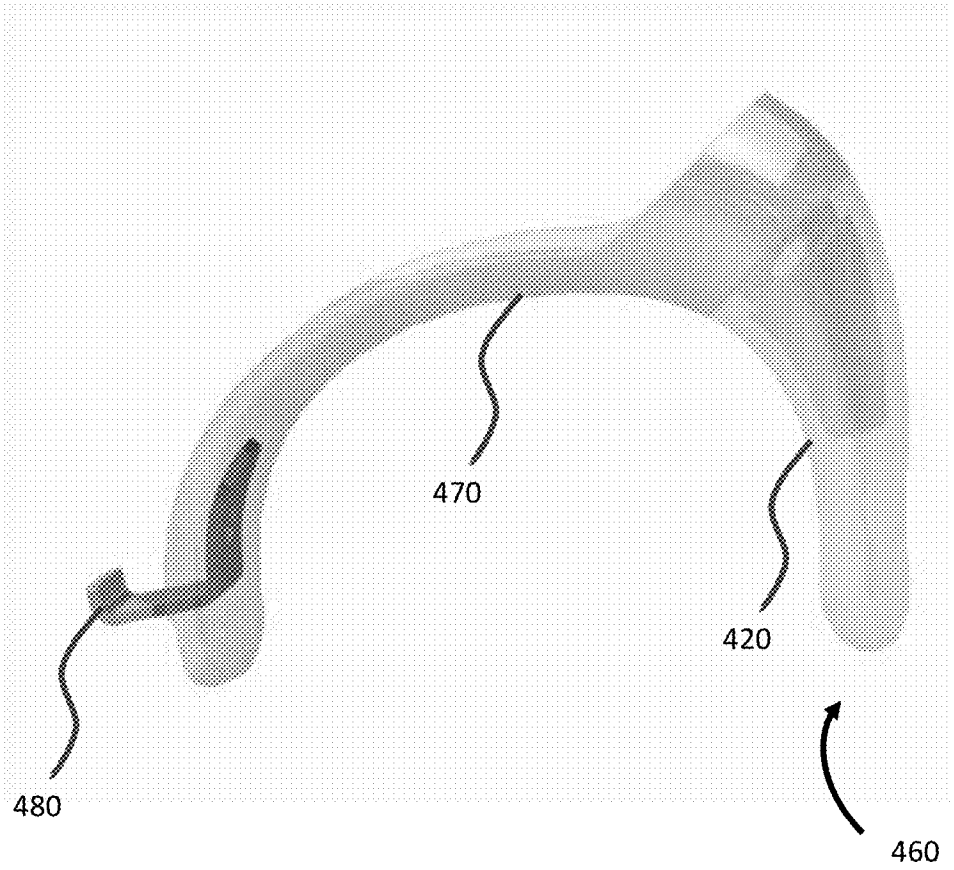
FIG. 14 depicts an ear hook apparatus according to an exemplary embodiment.

To this end, FIG. 14 depicts an ear hook apparatus 460 that provides ear hook functionality. Ear hook apparatus 460 is configured to make it more difficult to remove from the BTE device operational assembly than that which is the case with respect to removing the ear hook 490 in the embodiments above. More particularly, with respect to this embodiment, the ear hook apparatus 460 includes a male connector 480 that includes a hook portion at a distal end thereof. In this exemplary embodiment, a portion of the male connector 480, a proximal portion, is embedded in an ear hook chassis 470. Connected to this ear hook chassis 470 is an ear hook tip 420. In an exemplary embodiment, components 480, 470 and 420 are separate components, but are integral and non-removable relative to one another (by non-removable, it means that at least one component must be broken or otherwise permanently deformed from a relaxed/steady state/normal state). Some additional features of the ear hook apparatus 460 will be described below, but first, briefly, the general interface of the ear hook apparatus 460 with the other components of the BTE device will now be described.

Figure 15:
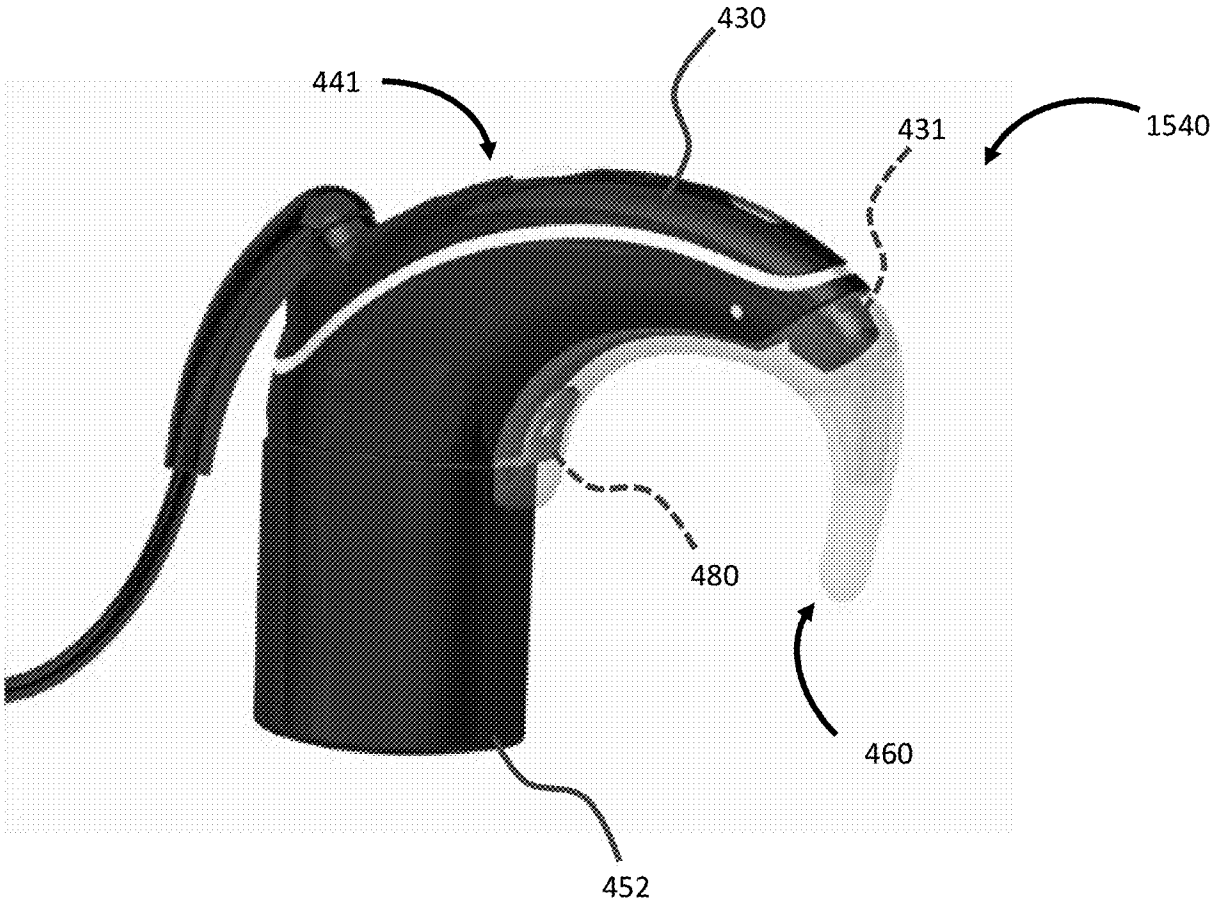
FIG. 15 depicts the ear hook apparatus of FIG. 14 attached to the BTE electronics component of the BTE device, to which a battery is attached.

FIG. 15 depicts an exemplary embodiment of the ear hook apparatus 460 interfacing with the BTE device operational assembly 441 to establish a BTE device 1540. In the embodiment of FIG. 15, the male connector 480 extends in between the base of the BTE electronics component 430 and the battery 452. In an exemplary embodiment, there is a recess that extends upwards from the base of the BTE electronics component 430 that accepts the hook portion of the distal portion of the male connector 480. Owing to the geometry of the battery 452 and the BTE electronics component 430, the male connector 480 cannot move upward or downward or to the left or to the right, at least not by any significant amount, when the BTE device operational assembly is assembled (i.e., the battery 452 is locked to the BTE device 430). By way of example only and not by way of limitation, in an exemplary embodiment, the BTE electronics module 430 includes a recess in the base thereof that receives the horizontal portion of the male connector 480. In effect, in at least some exemplary embodiments, when the battery subassembly 452 is connected to the BTE electronics module 430, the recess forms a tunnel from the outside and front of the BTE device operational assembly 441 to the recess that receives the hook portion (the vertical portion) of the male connector 480. By way of example only and not by way of limitation, in exemplary embodiment, the battery 452 has a recess in the top portion that receives the horizontal portion of the male connector 480, which too forms a tunnel from the outside front of the BTE device operational assembly 441. In an exemplary embodiment, the recess establishing the tunnel is entirely within the BTE electronics module 430. In an exemplary embodiment, the recess establishing the tunnel is entirely within the battery 452. Of course, in both instances, a portion of the tunnel is established by the other component. Here, there is simply no recess in that component. That said, in an exemplary embodiment, there is a recess in both the BTE electronics module 430 and the battery 452. In these exemplary embodiments, at least some of them, the tunnel prevents the male connector 480 from moving left, right, up and/or down (all directions relative to a view of the BTE device looking from the front (i.e., looking at the BTE device when worn on a person where the viewer is looking directly at the persons face). The tunnel can prevent the male connector from moving in only a left, only a right, only an up or only a down direction, or any combination of two or three of those directions. Any limitation of direction of movement that can have utilitarian value can be used in some embodiments.

Figure 16:
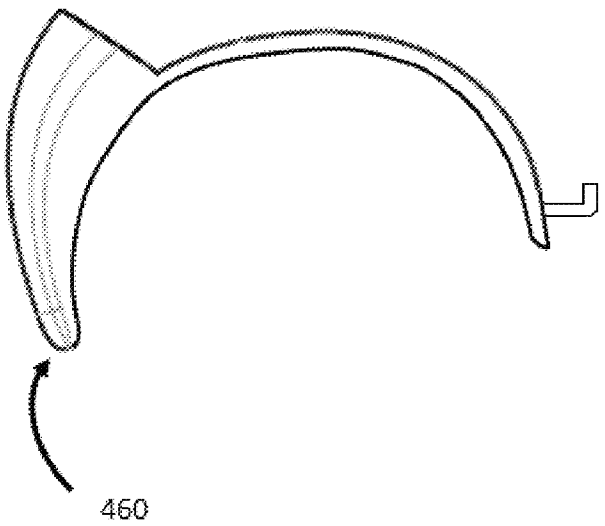
FIG. 16 depicts a side view of the ear hook apparatus of FIG. 14.
Figure 17A:
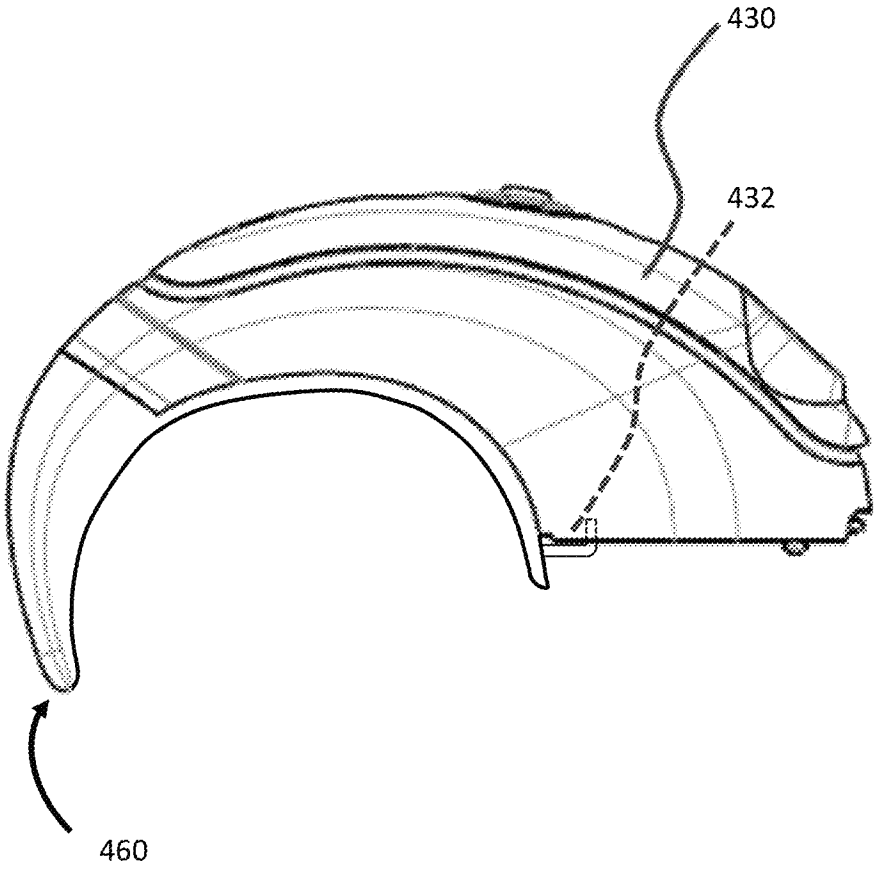
FIG. 17A depicts the ear hook apparatus of FIG. 14 attached to the BTE electronics component of the BTE device.
Figure 17B:
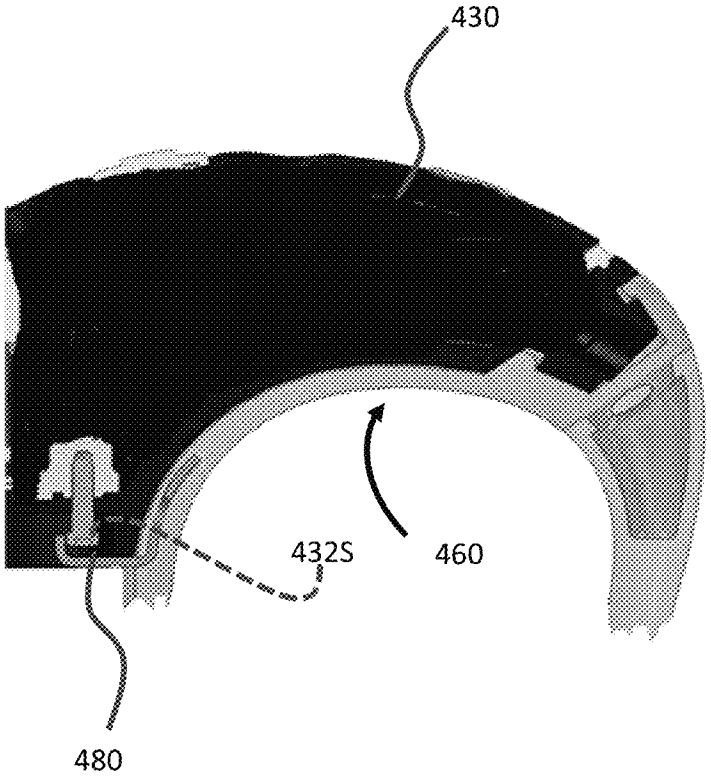
FIG. 17B depicts additional details of the ear hook apparatus of FIG. 14 attached to the BTE electronics component of the BTE device.

In an exemplary embodiment, the ear hook apparatus 460 is first put on the BTE electronics module 430 prior to attachment of the battery 452 there to. In this regard, FIG. 16 depicts a side view of the ear hook apparatus 460, by itself, and FIG. 17 depicts the ear hook apparatus 460 interfacing with the BTE electronics module 430. As can be seen, the hook portion (vertical portion) of the male connector 480 extends upwards into the base of the BTE electronics module 430. In this embodiment, lead line 432 points to structure interposed between the hook portion and the outside of the BTE electronics component. FIG. 17B provides an exemplary embodiment of such structure, screw 432S, which is screwed into the plastic body of the BTE electronics module 430. In some embodiments, the screw 432S reacts against the hook portion of the connector 482 that prevents the male connector, and thus the apparatus 460, from being removed from the BTE device operational assembly 441. In an exemplary embodiment, the hook portion reacts against a wall that is part of a metal connector on the BTE electronics module. For example, while the exterior of the BTE electronics module can be plastic or the like, the inside of the module can include metal parts. In an exemplary embodiment, the inside of the module facing or otherwise that interfaces with the battery can be metal. This pedal portion can form a portion that interfaces with the hook/that is interposed between the vertical portion of the male connector and the chassis when the apparatuses connected to the BTE electronics module.

In this regard, owing to the hook at the distal end of the male connector 480, and the geometry of the BTE electronics module 430, the male connector 480 cannot move forward away from the BTE electronics module 430 (because the hook portion extends into the recess, and the recess or other component of the BTE electronics module 430 includes a component that is located between the hook portion and the ear hook chassis 470). That is, when the chassis 470 is pulled forward/away from the BTE electronics module 430, the hook portion of the male connector 480 catches on the recess/the structure of the BTE electronics module 430 interposed between the hook portion and the outside of the BTE electronics module, thus preventing removal of the ear hook apparatus 460 from the BTE device operational assembly 441.

Figure 18:
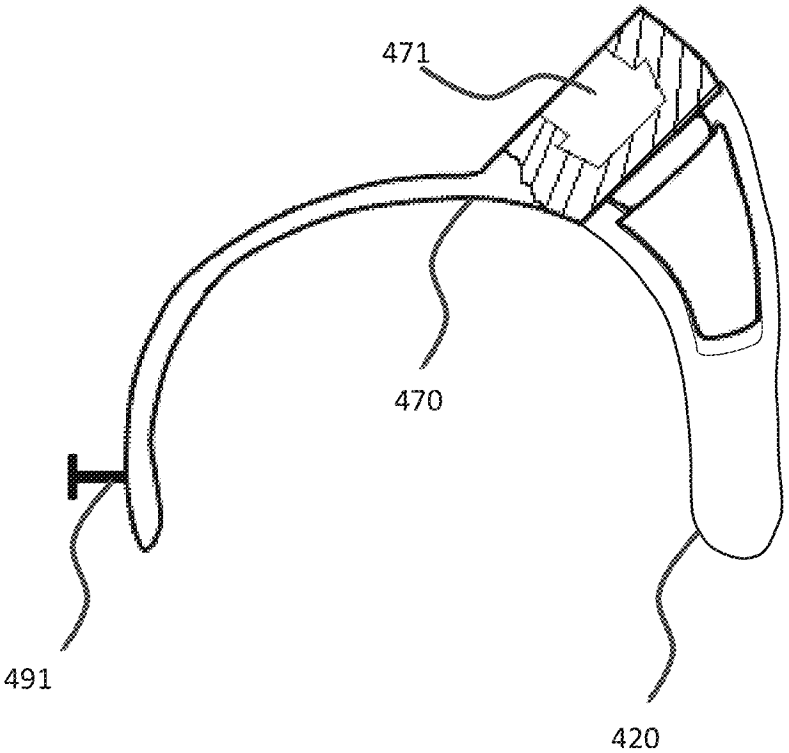
FIG. 18 presents an alternate embodiment of the ear hook apparatus.

In view of the above, it is to be understood that in an exemplary embodiment, there is an ear hook apparatus, such as ear hook apparatus 460, that includes an ear hook tip, such as ear hook tip 420, an ear hook chassis, such as chassis 470, and a male connector, such as male connector 480. In this exemplary embodiment, the ear hook apparatus is configured such that the male connector attaches to one or more components of a BTE device at and/or below the base of a BTE electronics module, such as module 430, of the BTE device. By "attaches to one or more components" of a BTE device at the base of a BTE electronics module, such corresponds to the embodiment of FIG. 17 where the hook portion of the male connector 480 extends upwards, thus attaching to BTE electronics module 430, electronics module 430 corresponding to one component of a BTE device. By attaches to one or more components of a BTE device below a base of a BTE electronics module, such corresponds to an embodiment where the hook portion of the male connector 480 extends downwards, thus attaching to battery 452, battery 452 corresponding to one component of a BTE device. With respect to this latter embodiment, in an exemplary embodiment, the recess that receives the hook portion can be located in the battery 452. It is noted that with respect to one or more components of a BTE device at and/or below the base of a BTE electronics module, such includes an embodiment where the hook is a dual hook (e.g., a sideways T, such as that seen in FIG. 18), where there is a recess both in the BTE electronics module 430 and the battery 452. Any arrangement that can enable the ear hook apparatus 460 to be secured in a fashion that frustrates removal thereof from one or more of the various components of the BTE device can be utilized in at least some exemplary embodiments. Some additional alternate embodiments corresponding to such will be described in greater detail below. First however, some additional features of the ear hook apparatus 460 will now be described.

Figure 19:
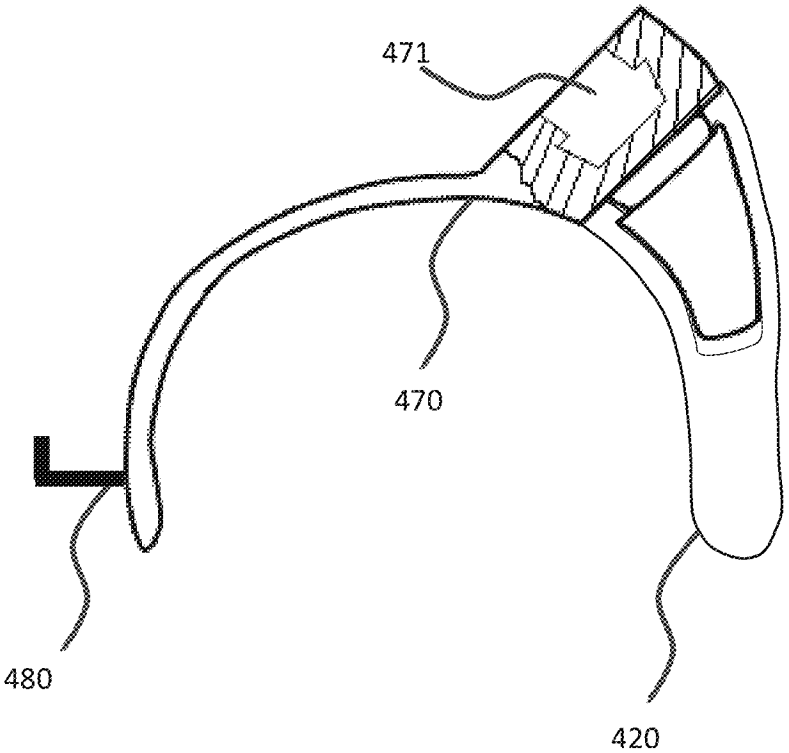
FIGS. 19-24 provide various views for various details of the ear hook apparatus of FIG. 14.

FIG. 19 depicts an exemplary embodiment of the ear hook apparatus 460, with a partial cross-sectional view of the chassis 470 and a total cross-sectional view of the ear hook tip 420 (crosshatching has been removed). As can be seen, there is a female portion in the ear hook chassis 470. In an exemplary embodiment, female portion 471 is sized and dimensioned to receive the male portion 431 of the BTE electronics module 430. In an exemplary embodiment, the ear hook chassis 470 is sized and dimensioned so that the chassis 470 snap fits on to the male portion 431 in a removable matter. In this regard, the material of the chassis 470 is configured to elastically deformed so as to snap onto and off of the male portion 431. That said, alternatively and/or in addition to this, is the male portion 431 of the BTE electronics module 430 that is configured to elastically deformed. In an exemplary embodiment, the ear hook tip is 420 is an overmolded body. In an exemplary embodiment, the ear hook tip and/or the chassis is a 70 Shore A, LSR KE-2093 overmolded body. In an exemplary embodiment, one or both components has a hardness of between 5 to 90 (inclusive, as is the case with respect to all ranges detailed herein unless otherwise noted) Shore A, and can have any value or range of values therebetween in about one increment. In some embodiments, the material is the same and/or the hardness is the same for the chassis and the ear hook tip, while in other embodiments, the material and/or the hardness can be different. In some exemplary embodiments, the hardnesses are different while the material is the same, and vis-a-versa. In an exemplary embodiment, the hardness of the chassis can be more than or less than 30%, 25%, 20%, 15%, 10%, 5% the hardness of the tip.

Figure 20:
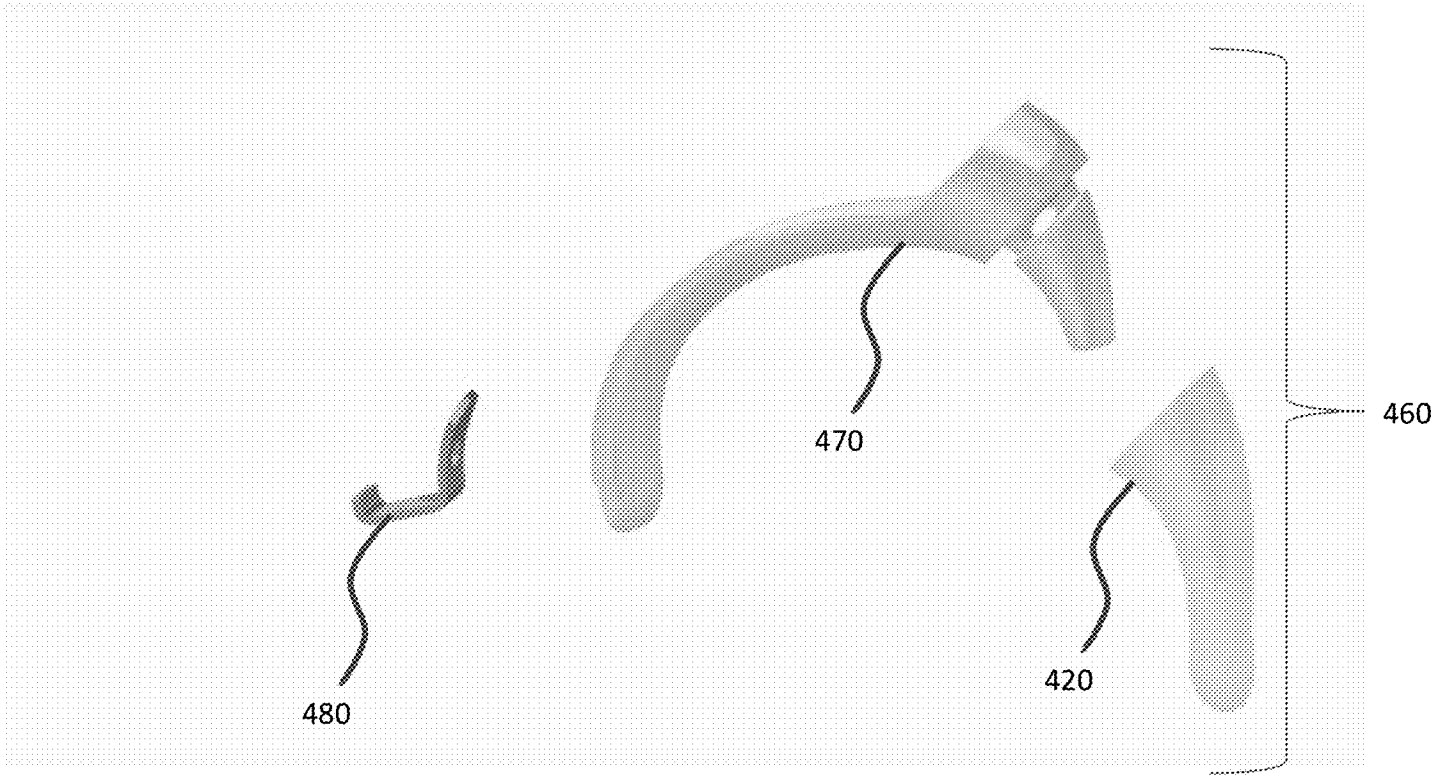
Figure 21A:
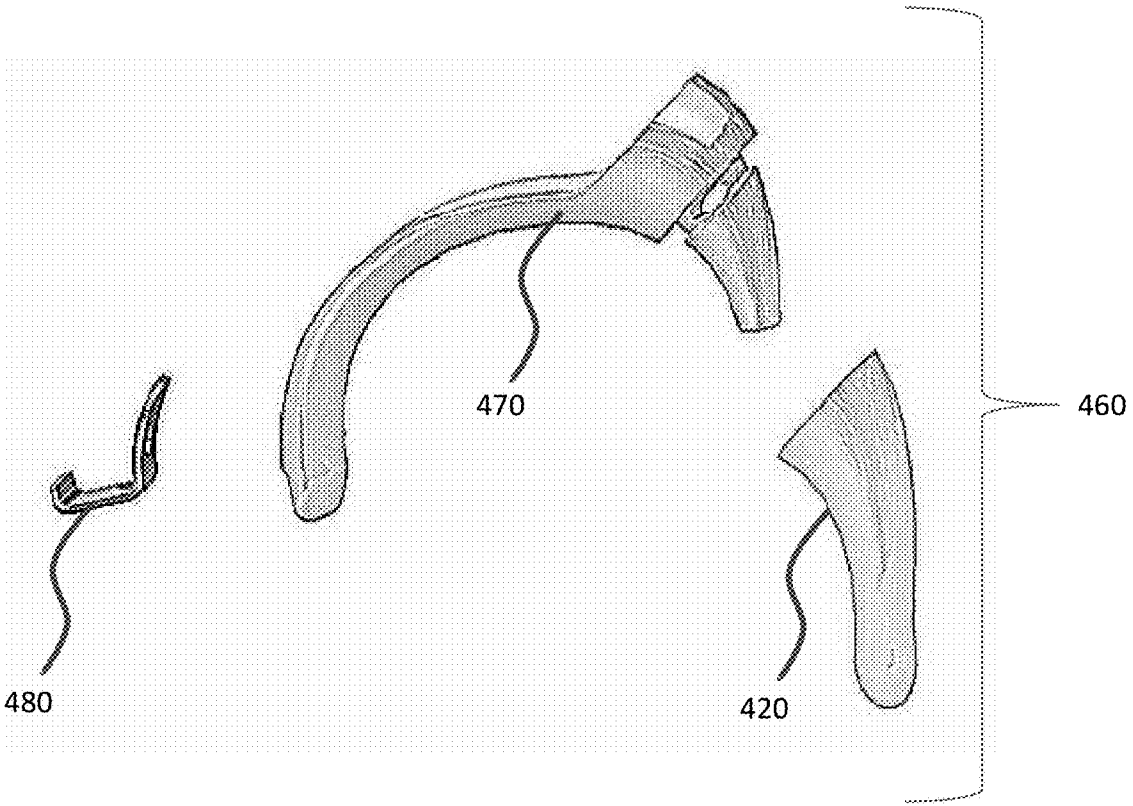

Still with reference to FIG. 19, it can be seen that there is a female portion of the ear hook tip 420 that receives a male portion of the chassis 470. In this regard, it is noted that in some embodiments, the hook tip 420 is molded around the already formed chassis 470. In this regard, in some embodiments, the ear hook apparatus 460 is three integral but non-monolithic components. FIGS. 20 and 21A depict an exploded view of the ear hook apparatus 460 depicting the 3 components, the chassis 470, the male connector 480, and the ear hook tip 420.

Figure 21B:
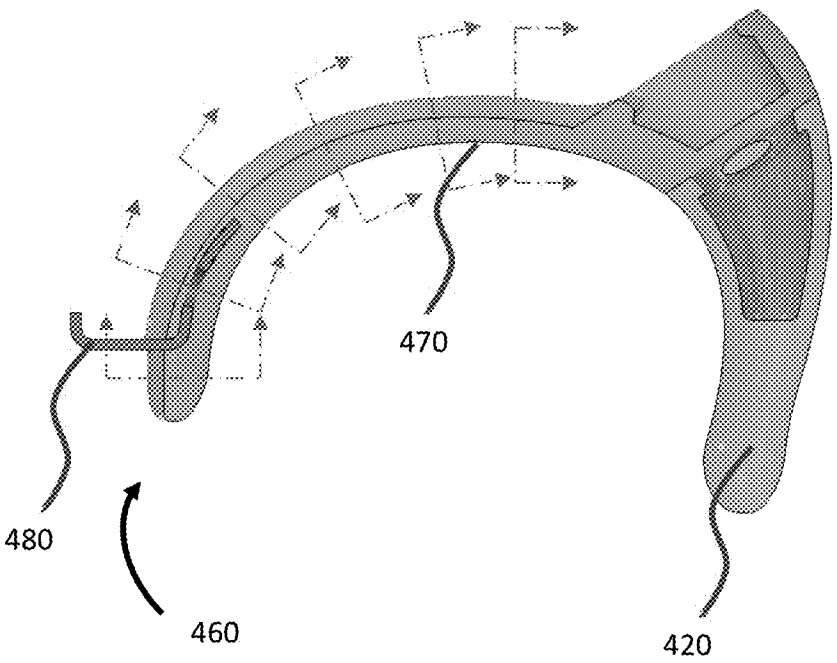

FIG. 21B depicts a transparent/semitransparent version of the ear hook apparatus 460, with the three components connected to each other to form the integral (but not monolithic) apparatus.

Figure 21C:
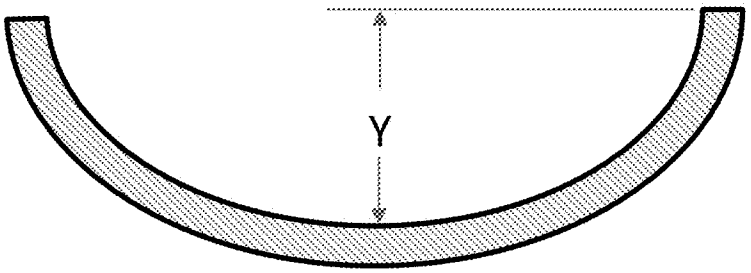
Figure 21D:
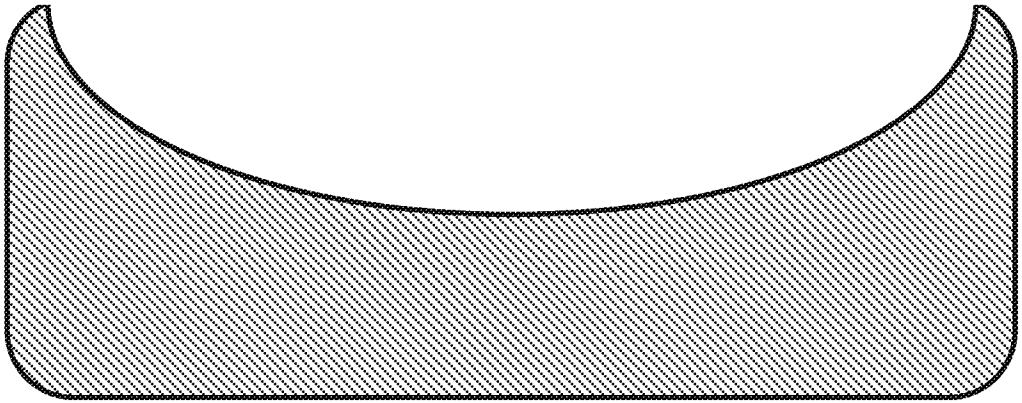

In an exemplary embodiment, the ear interface includes an open concave section that is concave relative to the BTE electronics module, which concave section interfaces with the BTE electronics module such that the BTE electronics module is located in the concave section. FIG. 21B depicts a series of cross-sections indicators through the apparatus 460 at various locations, and FIG. 21C depicts an exemplary conceptual cross-section that would correspond to that at those locations, clearly showing the concave section. Is noted that that is just an exemplary embodiment. Another exemplary embodiment can be seen in FIG. 21D, depicting a conceptual cross-section. The concave section is sized and dimensioned to contour to the front facing surface of the inside concave portion of the BTE device operational assembly 441 (the BTE electronics module 431 and/or the battery 452, to the extent that the ear hook apparatus 460 so interfaces).

Figure 22:
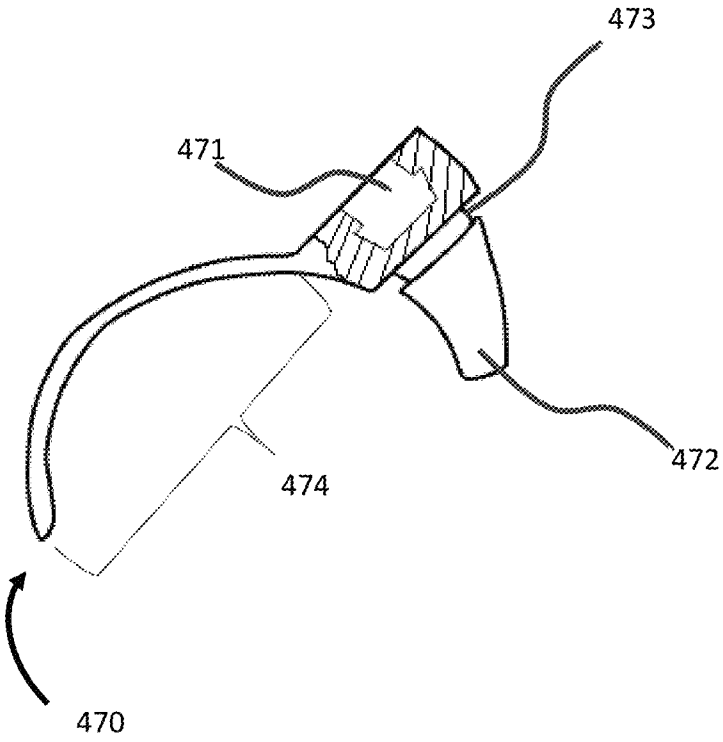

FIG. 22 depicts the ear hook chassis 470 in isolation, with a partial cutout view depicting the female portion 471. As can be seen, female portion 471 includes a section with a relatively constant diameter and then a section with a varying diameter the tapers from a wide diameter to a narrower diameter, that wide diameter again wider than the constant diameter of the beginning portion of the female portion. The wider diameter accommodates the corresponding wider diameter portion of the male component of the BTE electronics module 430 to achieve the apprehension snap coupling between the two components. Also as can be seen, the spine 474 of the ear hook chassis 470 extends from the sub-body that establishes the female portion 471 to a bottom tip. In an exemplary embodiment, the spine is flexible, thus permitting the spine, and thus the portions connected to the spine, to flex about the male connector 480 when the male connector is connected to the BTE device operational assembly (and when the top of the chassis is not connected to the male connector of the BTE electronics component).

In view of the above, it can be understood that in at least some exemplary embodiments, there is an ear hook apparatus, such as ear hook apparatus 460, wherein the ear hook apparatus is configured to attach to a body of a BTE electronics module away from the base thereof. By way of example only and not by way of limitation, the attachment to the body of the BTE electronics module is achieved via reception of the male component of the BTE electronics module 430 into the female component 471 of the ear hook chassis 470. It is to be understood that this is delta to the connection established by of the male connector 480 at the base/proximate the base of the BTE electronics module 430. Also in view of the above, it can be seen that the ear hook chassis 470 is configured to receive the male portion of the body of the BTE electronics module, and thereby facilitate an attachment to the body of the BTE electronics module.

As can be seen, the ear hook chassis includes a male portion that includes two portions, a first portion having a first, constant diameter (or at least relatively constant diameter), and a second portion having a varying diameter that tapers from the first portions of the second portion with reducing diameter from the first portion to the tip of the second portion.

Figure 23:
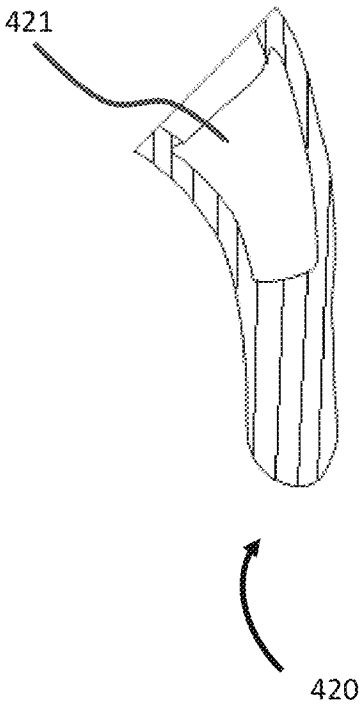

In an exemplary embodiment, these two portions interface with corresponding sections of the ear hook tip 420, presented in FIG. 23 in isolation from the other components of the ear hook apparatus 460, which includes a female portion 421 as can be seen. In an exemplary embodiment, the ear hook tip 420 is molded about the male portion of the ear hook chassis 470. That said, in an alternative embodiment, the ear hook tip 420 is formed separately from the ear hook chassis 470 and snap coupled thereto. In an exemplary embodiment, the snap coupling renders the ear hook tip 420 removal from the chassis 470, while in other embodiments, the snap coupling renders that ear hook tip 420 unremovable from the chassis 470 (meaning that it must be plastically deformed or otherwise broken to be removed). It is noted that in at least some exemplary embodiments where the ear hook tip 420 is molded about the ear hook chassis 470, the ear hook tip 420 can be removed only by plastically deforming the ear hook tip 420 or otherwise breaking the ear hook tip 420. Alternatively, the ear hook tip 420 can be removed only by plastically deforming the ear hook chassis 470 or otherwise breaking the chassis 470. Alternatively, the ear hook tip 420 can be removed only by plastically deforming one or both of the ear hook chassis 470 or the ear hook tip 420 or otherwise by breaking one or both of the ear hook chassis 470 or the ear hook tip 420.

Figure 24:
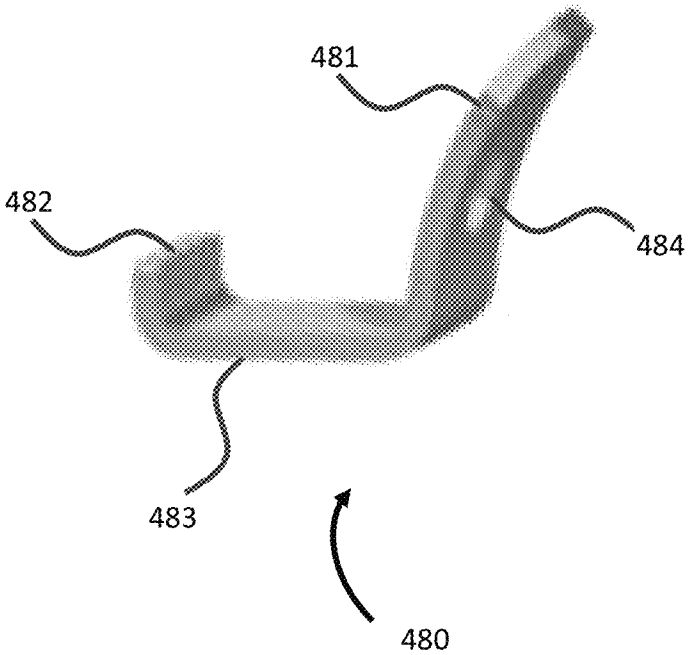
Figure 25:
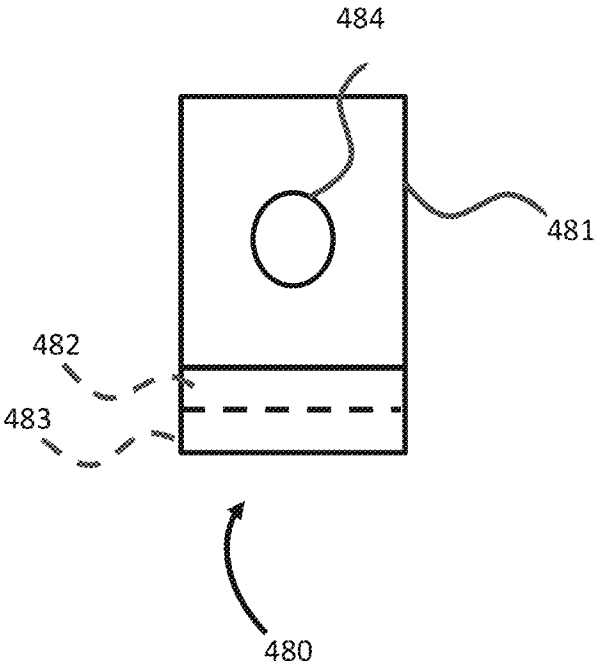
FIGS. 25 to 26D present alternate embodiments of an ear interface.

FIG. 24 presents an isometric view of the male connector 480 in isolation from the other components of ear hook apparatus 460, and FIG. 25 presents a front view of the connector 480 (looking towards the face of the person when the BTE device is worn on the person). In an exemplary embodiment, the male connector 480 is a monolithic metal component stamped from a flat plate of stock metal (stainless steel, titanium, aluminum, etc.) The male connector includes three portions. There is a first proximal portion 481 that is, at least in some embodiments, entirely embedded within the ear hook chassis 470. This first proximal portion 481 has a major direction of extension in the vertical direction, and a minor direction of extension in the horizontal direction, and is curved to generally follow the contours of the spine 474 of the ear hook chassis 470. There is also a second portion 483 that extends horizontally away from the first portion, where in some embodiments, only a portion thereof is embedded in the ear hook chassis 470 (while in other embodiments, no portion is embedded in the ear hook chassis 470). The second portion 483 supports the third portion 482, which extends vertically away from the second portion. This third portion 482 establishes the hook of the male connector 480. As can be seen, there is a hole 484 that extends completely through the first portion 481. In an exemplary embodiment, this provides a path for the pertinent portion of the ear hook chassis 472 extend their through so as to better secure the male connector 480 to the ear hook chassis 470 relative to that which would be the case in the absence of this hole 484. In this regard, in an exemplary embodiment, the male connector 480 is manufactured or otherwise formed separately from the ear chassis 470.

The formed connector 480 is placed into a mold into which, for example, material (e.g., plastic, PTFE, etc.) is injection (e.g., injection molded) to form the ear hook chassis 470. The ear hook chassis 470 is thus molded about the male connector 480, thereby securing the male connector 480 to the ear hook chassis 470. In an exemplary embodiment, the formed connector 480 is insert molded to the chassis. A portion of the male connector 480, at least the first portion 481, is embedded in the ear hook chassis 470. In an exemplary embodiment, the male connector 480 is embedded or otherwise attached to the ear hook chassis 470 such that the male connector 480 cannot be removed from the ear hook chassis 470 without plastically deforming or otherwise breaking the ear hook chassis 470. In an exemplary embodiment, the chassis 470 is made of TR90 1$^{st}$ shot.

In view of the above, it is to be understood that in an exemplary embodiment, there is an ear hook apparatus, such as ear hook apparatus 460 detailed above, wherein the male connector is a metal component establishing a concave hook relative to a BTE electronics module (spine) facing side of the ear hook assembly, the chassis 470 is a synthetic based component, and the chassis is molded about a portion of the male connector. Also in view of the above, the ear hook tip 420 is a separate component from the chassis 470 and is locked onto the chassis 470 (e.g., by injection molding ear hook tip 420 about the male portions 472 and 473, wherein the male portions 472 and 473 are sized and dimensioned such that with respect to the material that is utilized to make those portions and with respect to the material that is utilized to make the ear hook tip 420 and the final material properties thereof, the ear hook tip 420 and/or the ear hook chassis 470 must be plastically deformed or otherwise broken to remove the components from each other.

As noted above, in an exemplary embodiment, ear hook apparatus is configured so as to attach to one or more components of the BTE device at and/or below a base of a BTE electronics module of the BTE device, and the ear hook apparatus is further configured to attach to a body of the BTE electronics module away from the base. Accordingly, the ear hook apparatus is configured for dual connection to an operational assembly of the BTE device. The embodiment detailed above has the second attachment away from the base at the apex. However, in some alternate embodiments, the second attachment can be at other locations, such as a location midway between the base and the apex of the BTE electronics module. In this regard, by way of example only and not by way of limitation, in an exemplary embodiment, the ear hook chassis 470 can include a male portion that protrudes away from the spine 474 of the chassis 470 into the body of the BTE electronics module 430. This male portion could snap fit into the body of the BTE electronics module 430. Alternatively, the chassis 470 can include a female portion that surround the entire central body (or upper body) of the ear hook chassis 470 or partially surrounds the central body. Any arrangement of connecting the ear hook chassis 4702 the BTE electronics module 430 can be utilized in at least some exemplary embodiments.

It is noted that the male connector can be stronger than the ear hook chassis. In an exemplary embodiment, the male connector 480 has a yield strength of at least 5, 6, 7, 8, 9, 10, 11, 12, 13, 14, 15, 16, 17, 18, 19, 20, 25, 30, 35, 40, 45, 50, 55, 60, 70, 80, 90, 100, 125, 150, 175, 200, 200, 250, 300, 350, 400, 500, 600, 700, 800, 900, or 1000 times or more than that of the ear hook chassis 470. Still further, in an exemplary embodiment, the material of the chassis 470 is much more flexible/the chassis is sized and dimensioned and manufactured to readily flex relative to the male connector 480.

Still further, in view of the above, it is to be understood that in some exemplary embodiments, the ear hook chassis 470 includes a female receptacle 471 configured to receive a male portion 431 of the BTE electronics module 430 so as to attach the chassis 470 to the BTE electronics module at the apex thereof, and the male connector is configured to lock the chassis to the BTE electronics module 430 and/or to the battery 452.

In view of the above, it can also be seen that the ear hook chassis is a separate component from the ear hook tip and the male connector, and the male connector is a separate component from the ear hook tip. That said, in an exemplary embodiment, the ear hook tip and the chassis can be a monolithic component. That is, they can be formed from one and the same body. Note also that in at least some exemplary embodiments, it is possible that the male connector 480 can be a monolithic component with the ear hook chassis 470. It is noted that in some exemplary embodiments, the portion can still be reinforced, such as by utilizing a mesh that extends from the spine of the ear hook chassis 470 into the component that extends into the BTE device operational assembly. In an exemplary embodiment, a sufficiently strong material can be utilized to make the ear hook chassis. That said, in some embodiments, it may not necessarily be required that the ear hook apparatus 460 have the aforementioned childproof features above. Indeed, in some exemplary embodiments, there can be utilitarian value with respect to utilizing the ear hook apparatus 460 with an adult, and thus reaping the benefits of some additional attachment beyond the attachment at the apex of the BTE electronics device 430.

Also in view of the above, it can be seen that in an exemplary embodiment, there is a behind-the-ear (BTE) device, such as BTE device 1540, including a BTE electronics module 430, and an ear interface, such as by way of example but not by way of limitation, the ear hook apparatus 460. This exemplary embodiment, the ear interface is operationally removable from the BTE electronics module 430, the ear interface includes a portion configured to extend in front of a pinna when the BTE device is worn behind the ear (e.g., portion 420, the ear hook tip) and the ear interface is safety connected to the BTE electronics module 430.

Figure 26A:
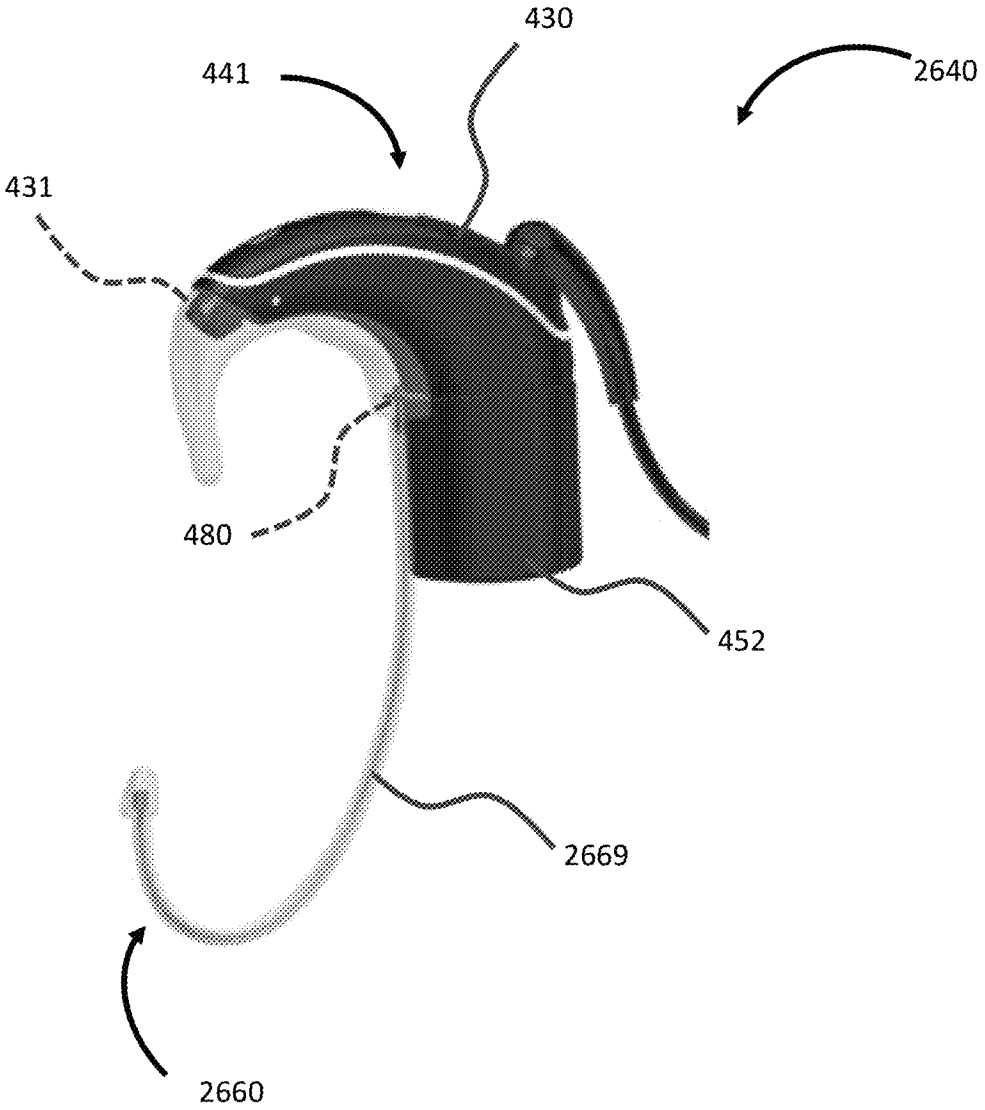

In an exemplary embodiment, the ear interface can be something different than the ear hook apparatus 460. In another exemplary embodiment, the ear interface can be a C shape structure, as seen in FIG. 26A. Here, there is a BTE device 2640 that includes an ear interface 2660. The ear interface 2660 includes a structure in the form of a C shape. In this embodiment, for the most part, the retention chassis is the same as that detailed above, and it stops at a location just below the BTE electronics module 430 as can be seen. Extending from the chassis is a malleable component 2669 that establishes the C-shape below the chassis. In an exemplary embodiment, flexible component 2669 includes a malleable metal wire or rod or any other utilitarian structure is embedded in a resilient/flexible material that is suitable to interface with the skin, such as a biocompatible plastic. In this exemplary embodiment, the flexible component 2669 is configured to be bent by the recipient using his or her fingers so as to conform to the underside and the front of the pinna. The malleable metal wire or rod, etc., is connected to the male connector 480 in general, and at the horizontal portion thereof. In an exemplary embodiment, the horizontal portion of the male connector 480 includes a hole therein through which the metal wire extends and is clamped thereto.

That said, it is noted that in at least some exemplary embodiments, the bottom portion that establishes the C shape is an extension of the ear hook chassis 470. That is, the ear hook chassis extends further than that which is depicted in the figures above with respect to ear hook chassis 470. In some exemplary embodiments, there is a malleable spine within the material of the ear hook chassis. In an exemplary embodiment, this can be achieved by molding the ear hook chassis about the spine in a manner analogous to or otherwise the same as that which was utilized to have the male connector 480 partially molded into the ear hook chassis 470.

Note further that in at least some exemplary embodiments, there is no malleable spine located in the bottom C shape. Instead, the bottom C shape can be a monolithic body and/or can be monolithic with the ear hook chassis 470.

Figure 26B:
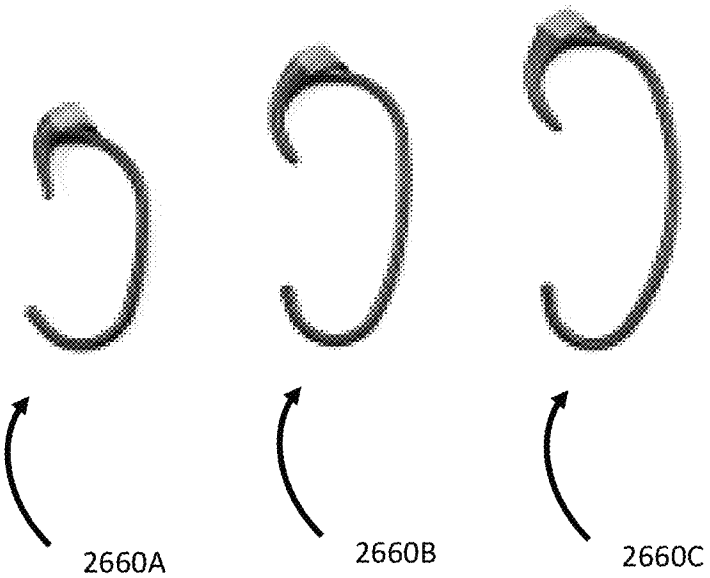

FIG. 26B depicts different size ear interfaces 2660A, 2660B and 2660C. In an exemplary embodiment, a recipient or a care giver can select which one is appropriate for a given scenario of use and/or for a given physiology of the recipient. Accordingly, an exemplary embodiment includes choosing different size ear interfaces.

Figure 26C:
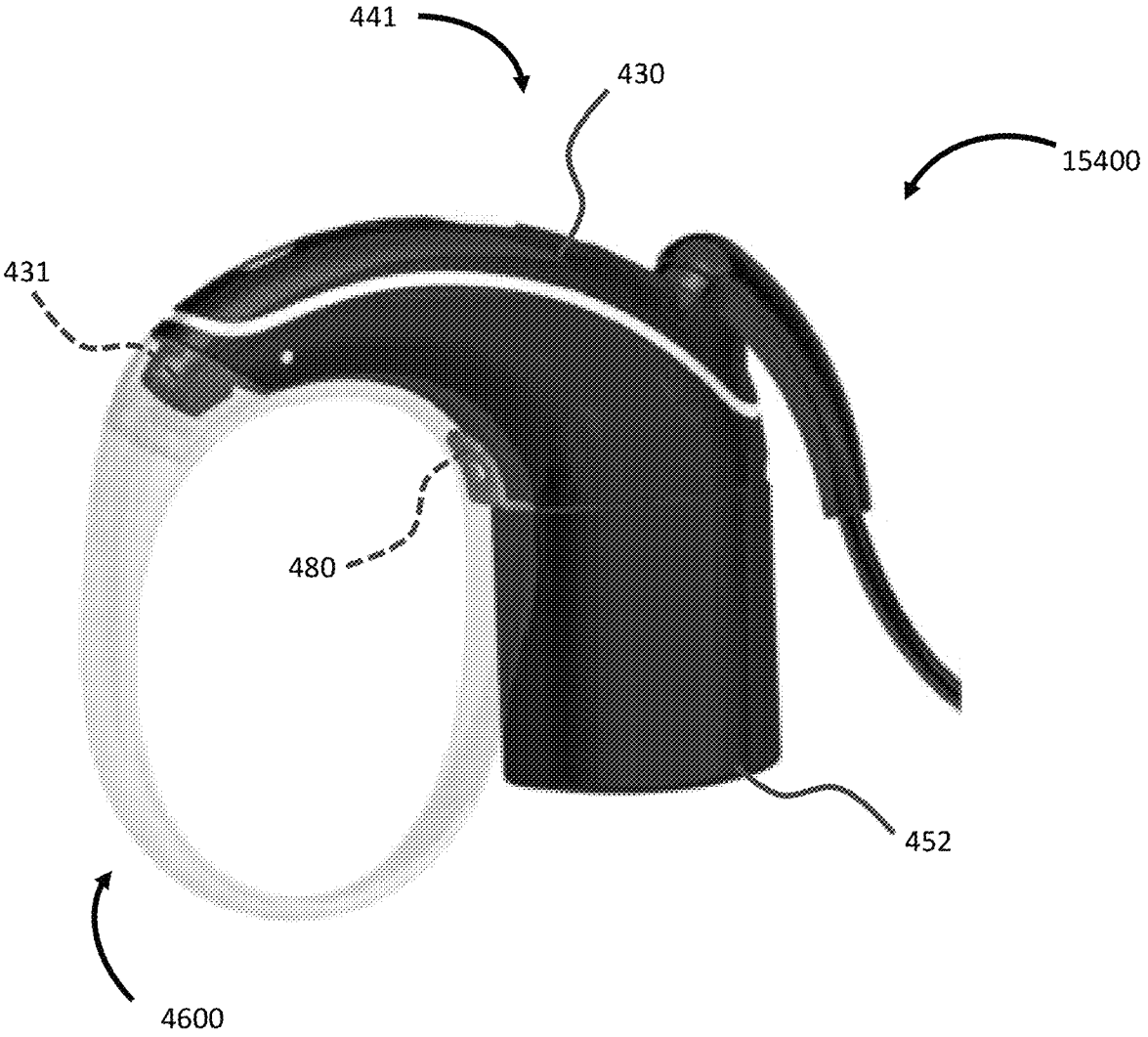

FIG. 26C depicts a different embodiment of a BTE assembly 15400, where an ear loop 4600 is attached to the BTE electronics module 430. Here, instead of an ear hook tip, an extension extends in a loop back to the chassis.

Figure 26D:
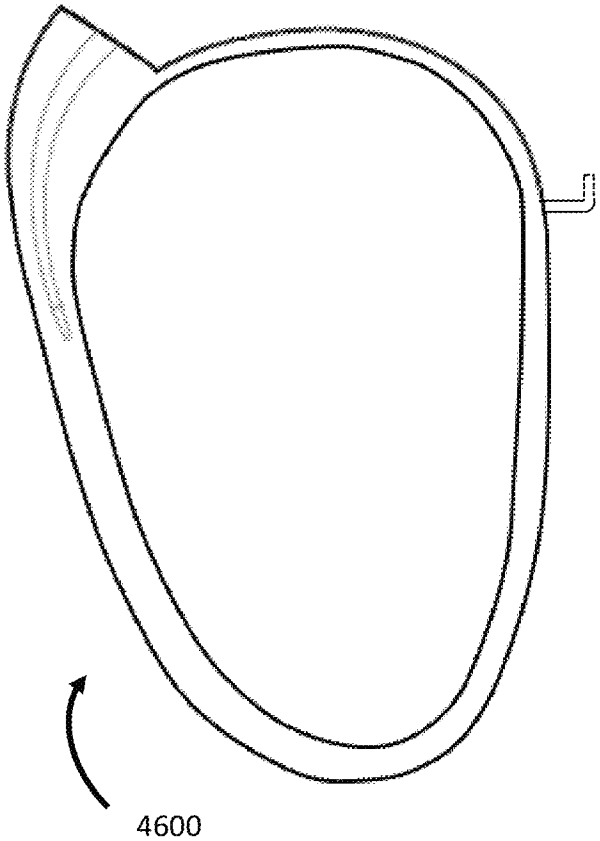

FIG. 26D depicts the ear loop 4600 alone from the BTE electronics module. It is noted that in at least some exemplary embodiments, the components of the apparatuses detailed above can be present in the loop (e.g., the male connector, the snap fit portions that snap onto the male portion of the BTE electronics module, etc., the types of materials (e.g., the loop body can be the same material as the ear hook tip, the loop can be attach to a chassis according to the teachings herein, the loop and chassis can be a monolithic component or an integral component etc.).

To be clear, it is noted that in at least some exemplary embodiments, any disclosure herein of a female component can correspond to a disclosure of a male component in alternate embodiments and vice versa, providing that the art enables such.

Accordingly, in view of the above, in an exemplary embodiment, with respect to the portion of the ear interface configured to extend in front of a pinna when the BTE device is worn behind the ear, and an exemplary embodiment, that is an ear loop, while another exemplary embodiments, that is in ear hook tip.

As seen above, with respect to ear hook apparatus 460, the ear interface in totality extends along the BTE electronics module to just beyond the end of the BTE electronics module (as opposed to the ear interface 2560, which would extend well beyond just the end of the BTE electronics module—in fact, in some embodiments, the location just beyond or even well beyond the battery). In an exemplary embodiment, by way of example only and not by way of limitation, with respect to FIG. 27, which shows a distance D1 from the base of the BTE electronics module to the tip of the spine of the ear hook apparatus 460, D1 is about X, where X is any value of 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.25, 3.5, 3.75, 4.0, 4.25, 4.5, 4.75, 5.0, 5.25, 5.5, 5.75, 6.0, 6.25, 6.5, 6.75, 7.0, 7.25, 7.5, 7.75, 8.0, 8.25, 8.5, 8.75, 9, 9.25, 9.5, 9.75, 10.0, 10.25, 10.5, 10.75, 11.0, 11.5, 12, 12.5, 13, 13.5, 14, 14.5, 15, 16, 17, 18, 19, 20, 21, 22, 23, 24 or 25 mm.

In an exemplary embodiment, D1 is greater than X. In an exemplary embodiment, D1 is less than X. In an exemplary embodiment, X is any value a range of values in between 0.1 mm and 40 mm in 0.01 mm increments (e.g., 2.22 mm, 1.56 mm, 0.42 mm to 8.87 mm, etc.).

In an exemplary embodiment, the extension past the base of the BTE electronics component 430 can of utilitarian value with respect to providing additional support beneath the male connector 480. Also, in an exemplary embodiment, such can provide additional resistance to bending of the ear hook apparatus 460 because the part that extends past the base will act as a lever to resist such bending.

Figure 21E:
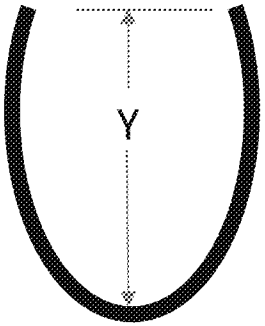
Figure 21F:
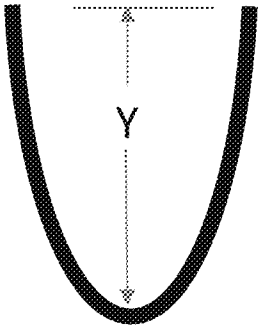
Figure 27:
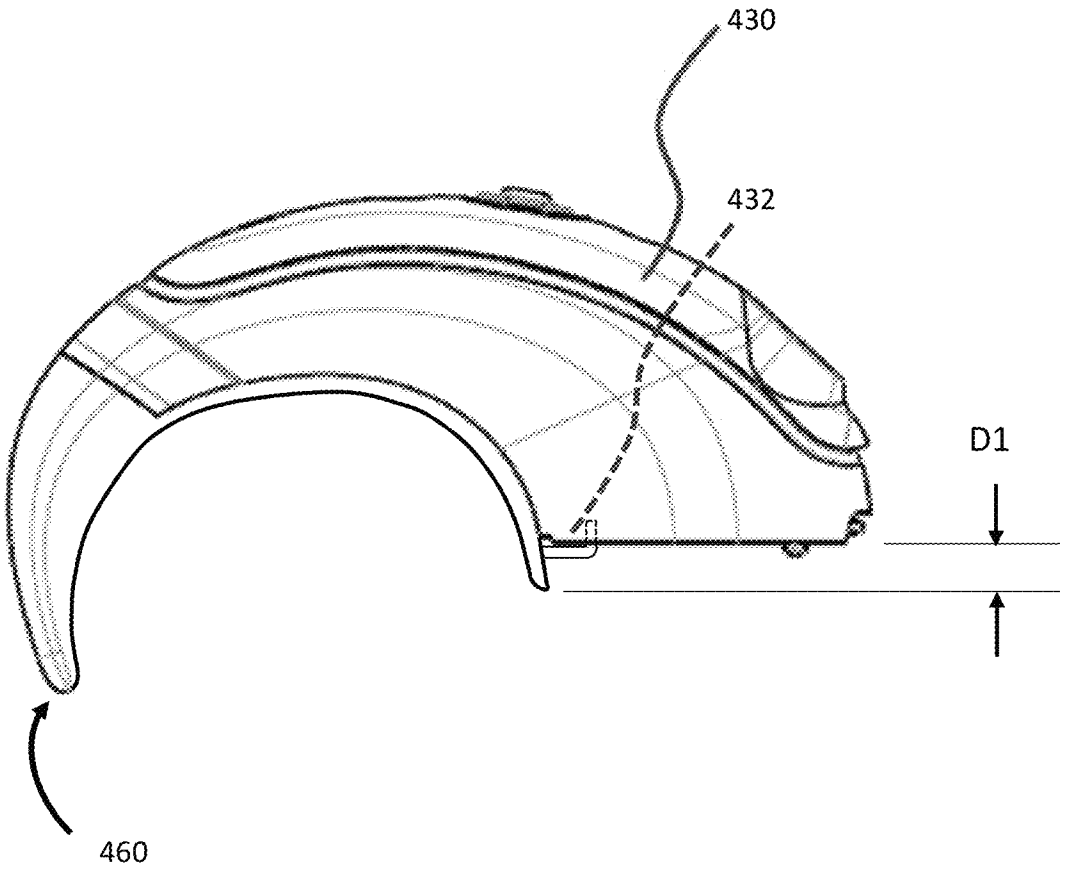
FIG. 27 presents exemplary details of the ear interface.

As noted above with respect to FIGS. 21B, 21C and 21D, in an exemplary embodiment, the ear interface is configured to be completely interposed between a concave portion of the BTE electronics module and a pinna of the recipient when worn on the recipient. This is seen in FIG. 27, where the concave portion of the BTE electronics module (the side facing the spine of the ear hook apparatus 460) is the side that interfaces with the ear hook apparatus 460, and thus when worn on the pinna, the ear hook apparatus 460 is completely interposed between that portion and the pinna. It is noted that in some embodiments, the ear hook apparatus 460 extends at least partially around the lateral sides of the BTE electronics module 430. By way of example only and not by way of limitation, exemplary embodiment, with respect to distance in the plane of FIG. 27 from the concave portion of FIG. 27 (the part that directly interfaces with the portion of the spine shown in FIG. 27), the ear hook apparatus 460 extends a distance about, more than, or no more than Y, where Y is 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.25, 3.5, 3.75, 4.0, 4.25, 4.5, 4.75, 5.0, 5.25, 5.5, 5.75, 6.0, 6.25, 6.5, 6.75, 7.0, 7.25, 7.5, 7.75, 8.0, 8.25, 8.5, 8.75, 9, 9.25, 9.5, 9.75, or 10.0 mm. This distance is the distance Y shown in the FIG. 21C. That said, Y can also be variable with respect to location on the spine along the length thereof. The chassis 470 and have an extended U-shaped cross-section (more on this below) such that it envelops a substantial portion of a lateral circumference, but not all, of the electronics module 430 and develops a substantial portion of a lateral circumference, but not all, of the battery 452. In an exemplary embodiment, the material of the retention chassis resiliently compresses about the BTE electronics module 430 and/or the battery 452 to hold the ear hook apparatus in place. It can also be C-shaped, as seen in FIG. 21E. In an exemplary embodiment, the material of the ear hook chassis couples about the electronics module and/or the battery 430. In an exemplary embodiment, the U-shaped and/or C-shaped cross-section of the chassis snap fits onto the BTE electronics component. In an exemplary embodiment, there are detent components on the inside of the C shape that are utilized to enable the ear hook chassis to be retained to the BTE device operational assembly 441 (such can be executed by a C-shaped cross-section, where the ends of the C extend about much of the operational assembly, so as to couple thereto—removal is by pulling the chassis away from the BTE device operational assembly so as to deform the C-shaped of the chassis outwards to provide clearance along the BTE device operational assembly so that such can be removed (the deformation is a result of the larger diameter portions of the operational assembly as it moves through the tips of the C). In some embodiments, it is the ear hook apparatus that includes the male portions of the detent, while in other embodiments, it is vice versa, while still in other embodiments, there are some male components on the ear hook apparatus and some male components on the BTE device operational assembly, and some female components one the BTE device operational assembly and some female components on the ear hook apparatus. In an exemplary embodiment, Y (which would reflect the distance to the tips of the C) can be any of the aforementioned values or can be 11, 12, 13, 14, 15, 16, 17, 18, 19, 20, 21, 22, 23, 24, 25, 26, 27, 28, 29 or 30 mm or any values or range of values between any of the aforementioned Y values in 0.01 mm increments. FIG. 21F depicts an exemplary cross-section of the spine of the ear hook chassis which can have utilitarian vale using, for example, detents noted above, and can also have utilitarian value without the detents noted above.

In an exemplary embodiment, the ear interface is safety connected to the BTE electronics module via an interference connection relative to the BTE electronics module. In this regard, this can be achieved via the male connector 480 as detailed above, where the hook portion of the male connector 480 becomes trapped in between the BTE electronics component 430 and the battery. That is, components of the BTE device operational assembly interfere with components of the ear hook apparatus 460. That said, in an alternative embodiment, a screw is utilized to achieve the interference connection relative to the BTE electronics module. By way of example only and not by way of limitation, in an exemplary embodiment, a hole can be present through the horizontal portion 483 of the male connector 480. In an exemplary embodiment, a threaded bore can be located in the base of the BTE electronics module 430. In an exemplary embodiment, with the battery removed, the screw, such as a Phillips head screw, or a machine screw, can be screwed through the hole and into the threaded bore, thus achieving the aforementioned safety connection via an interference connection. It is noted that in an alternative embodiment, such can also be done or alternatively be done with respect to the battery 454.

It is noted that while the aforementioned embodiment utilizing a screw has been described in terms of utilizing a screw that extends the horizontal portion 483 of the male connector 480, alternatively, and/or in addition to this, the screw can extend through, for example, the portion 481, such as through the hole 484, where, in an exemplary embodiment, the side of the BTE electronics component 430 that has the concave portion has a threaded hole therein to receive this screw. That said, in an alternative embodiment, there is no male connector per se. Instead, a screw is screwed through the ear hook chassis 470 and into the BTE electronics module 430. In some embodiments, there is a reinforced portion embedded within the ear hook chassis 470, such as by way of example only and not by way of limitation, a component corresponding to only the portion 481 of the male connector 480. In this regard, no part of the reinforced portion extends out of the ear hook chassis 470. This reinforced portion provides reinforcement for the aforementioned screw.

In an exemplary embodiment, the ear interface is safety connected to the BTE electronics module via a component of the ear interface that extends between the BTE electronics module and a battery attached to the BTE electronics module, consistent with the embodiment of FIG. 17. In an exemplary embodiment, the ear interface is only removable from the BTE device by removing a battery attached to the BTE electronics module. By way of example only and not by way of limitation, as detailed above, the battery forms a portion of the tunnel through which the male connector 480 extends, and provides reaction force against movement of the male connector and the downward direction. Thus, the hook portion cannot be removed from the recess in which it is located in the BTE electronics module while the battery is connected to the BTE electronics module.

By safety connected to the BTE electronics module, it is meant that the ear interface cannot be removed from the BTE electronics module with the battery connected thereto (in embodiments that rely upon the battery to help secure the ear interface) without breaking the ear interface.

In an exemplary embodiment, the ear interface is connected to the BTE electronics module such that the ear interface cannot be removed by a child of three years old, four years old, five years old, six years old, seven years old, and/or eight years old (at least without removing the battery, in such embodiments), which child is a 50 percentile, 55 percentile, 60 percentile, 65 percentile, 70 percentile, 75 percentile, 80 percentile, 85 percentile, 90 percentile, and/or 95 percentile human factors male and/or female native-born inhabitant of the United States of America as of Jul. 4, 2017, or the closest date thereto where such human factors engineering statistics for such a child are available.

In an exemplary embodiment, the aforementioned human factored child is using only his or her bare hands, and is not utilizing a leverage evoking devices.

It is noted that embodiments can have utilitarian value with respect to kits. For example, there can be utilitarian value with respect to changing out a traditional ear hook and replacing it with one of the aforementioned ear hook apparatus as detailed herein, or vice versa. Such can have utilitarian value, at least with respect to the latter, with respect to a child who, as he or she grows older, is no longer need of the ear hook apparatus of the like that has the locking features detailed above. By way of example only and not by way of limitation, a BTE device can be sold that includes both the ear interface 460 and the ear hook 490, and the recipient or the recipient's parents can swap out the two components as a given scenario provide utilitarian value therefore.

Accordingly, in an exemplary embodiment, there is a kit, comprising, a BTE device as detailed herein or any variation thereof, which can include in ear hook 490 or an ear interface 460, wherein in the kit further includes the other of an ear hook 490 or an ear interface 460. In this exemplary embodiment, both the ear hook and the ear interface are removably attachable to the BTE electronics module when the other is removed there from.

Figure 28:
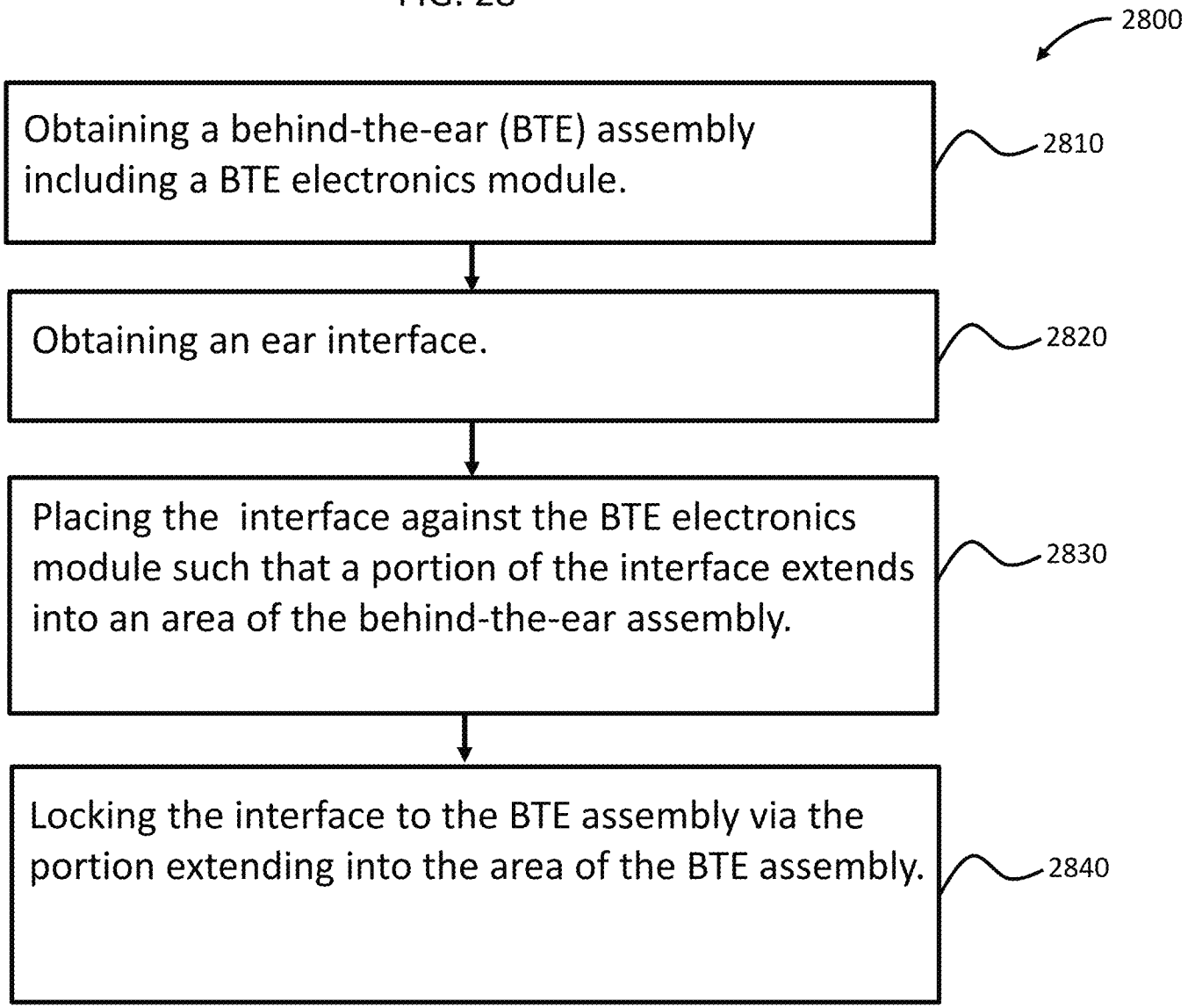
FIGS. 28-32 provide exemplary flowcharts for exemplar methods according to some embodiments.
Figure 29:
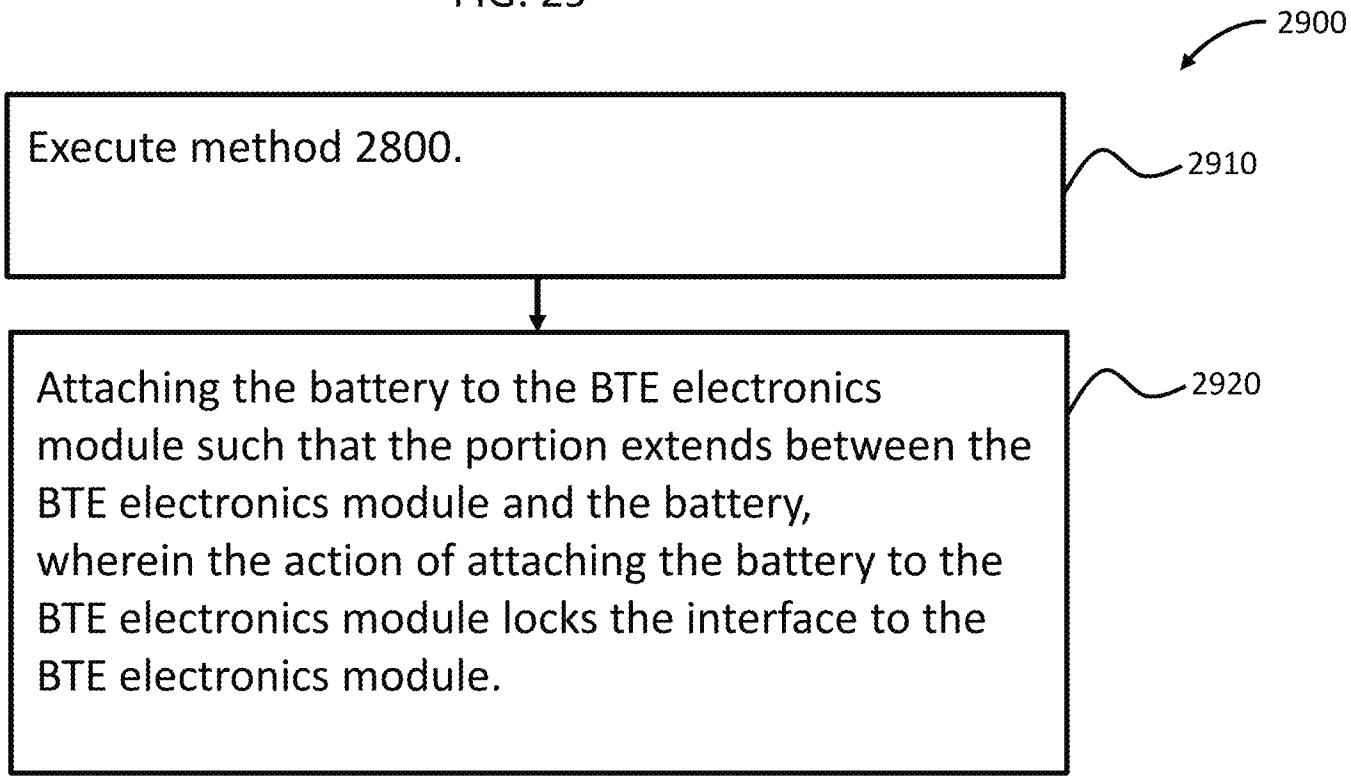

It is noted that some exemplary embodiments also include methods. In this regard, FIG. 28 presents a flowchart for an exemplary method, method 2800. Method 2800 includes method action 2810, which includes obtaining a behind-the-ear (BTE) assembly including a BTE electronics module, such as BTE electronics module 430. Method 2800 includes method action 2820, which includes obtaining an ear interface, such as ear interface 460 detailed above. Method 2800 further includes method action 2830, which includes placing the ear interface against the BTE electronics module such that a portion of the interface extends into an area of the behind-the-ear assembly. By way of example only and not by way of limitation, such can correspond to the action of placing the male connector 480 into the recess in the base of the BTE electronics module. Still further by way of example only and not by way of limitation, such can correspond to the action of placing the horizontal component of the male connector in between the battery in the BTE electronics component. Still further, by way of example only and not by way of limitation, in an exemplary embodiment, such can correspond to screwing a screw through the spine of the ear hook apparatus 460 into a threaded hole in the concave portion/the side of the BTE electronics module that includes the concave portion. In an embodiment, a so-called quarter turn device or the equivalent thereof can be utilized to attach the chassis to the BTE electronics module, which quarter turn can be carried by the spine of the ear hook apparatus 460. Method 2800 further includes method action 2840, which includes locking the ear interface to the BTE assembly via the portion extending into the area of the BTE assembly. It is noted that method action 2830 and method action 2840 can be executed by the same action. More accurately, method action 2840 can be a result of method action 2830. Conversely, method action 2840 can be a separate action.

In an exemplary embodiment, the BTE assembly includes a battery removably attachable to the BTE electronics module (e.g., elements 454 and 430, respectively). In an example embodiment, the action of placing the interface against the BTE electronics module results in the portion of the interface extending underneath the BTE electronics module into a battery interface section such that the interface is locked to the BTE assembly. By battery interface section, it is meant the portion of the BTE electronics module that interfaces with the battery. In some embodiments of this embodiment, such can be executed utilizing an embodiment that does not use the battery per se to lock the ear interface to the BTE electronics module. That is, in an exemplary embodiment, this feature of this method can be executed utilizing the aforementioned hook of the male connector 480 along with a screw as detailed above and/or even a component without the hook portion, such as a male connector that does not include portion 482 but only includes portion 483 and portion 481, where there is a hole through portion 483 for a screw.

In an exemplary embodiment of this embodiment, the BTE assembly includes a battery removably attachable to the BTE electronics module, consistent with some of the teachings detailed above. Further, the action of placing the ear interface against the BTE electronics module results in the portion of the ear interface extending underneath the BTE electronics module into a battery interface. In an exemplary embodiment of a method of utilizing such an exemplary embodiment, the method, such as method 2900, which includes method action 2910, which corresponds to executing method 2800, wherein this method 2900 further includes method action 2920, which includes the action of attaching the battery to the BTE electronics module such that the portion extends between the BTE electronics module and the battery, wherein the action of attaching the battery to the BTE electronics module locks the interface to the BTE electronics module.

Figure 30:
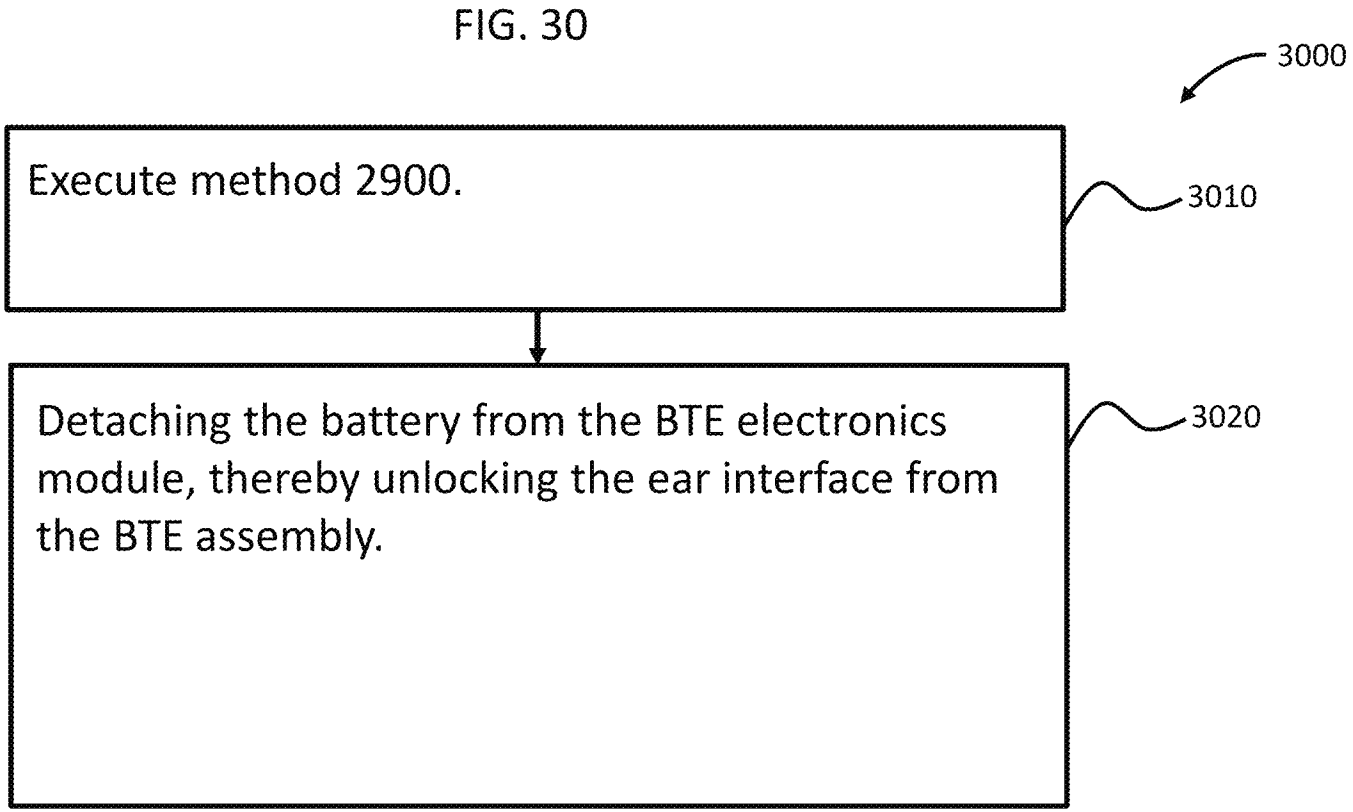
Figure 31:
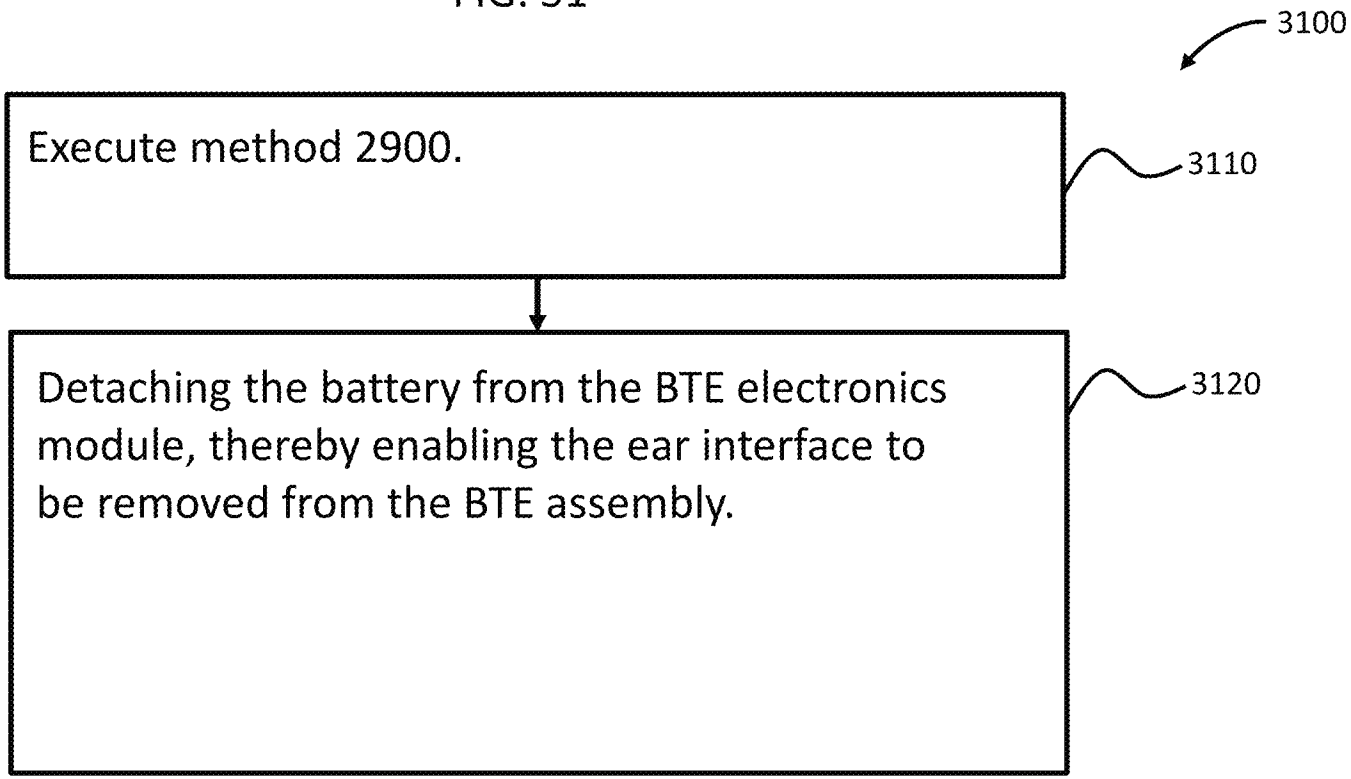

FIG. 30 presents an exemplary flowchart for an exemplary method, method 3000, which includes method action 3010, which includes executing method 2900. Method 3000 further includes method action 3020, which includes detaching the battery from the BTE electronics module, thereby unlocking the ear interface from the BTE assembly. Corollary to this is method 3100, which is presented in the exemplary flowchart in FIG. 31. Method 3000 includes method action 3110, which includes executing method 2900. Method 3100 further includes method action 3120, which includes detaching the battery from the BTE electronics module, thereby enabling the ear interface to be removed from the BTE assembly (this as opposed to the situation that exists prior to the removal of the battery for the pertinent embodiments, such as the embodiment of FIG. 17, where the battery must be removed before the ear interface is removed.

In view of methods 3000 and 3100, an exemplary method includes executing method 2900, and executing method action 3020 and/or method action 3120.

With respect to the embodiments detailed above vis-à-vis the action of placing the interface against the BTE electronics module, such action can also result, in at least some embodiments, in a second portion of the ear interface attaching to a separate portion of the BTE electronics module in a non-locking manner. By way of example only and not by way of limitation, this can correspond to the female portion 471 of the ear interface component 460 receiving the male portion 431 of the BTE electronics component 430.

In an exemplary embodiment, the above-noted ear interface includes three sections including an ear hook section configured to extend in front of a pinna, a crown section configured to extend over the pinna, and a back section that extends behind the pinna, and the ear interface is configured to flex such that at least portions of the three sections pull away from the BTE electronics module while the ear interface is locked to the BTE assembly.

Consistent with the above, with respect to the action of placing the ear interface against the BTE electronics module such that a portion of the interface extends into an area of the behind-the-ear assembly, the portion of the ear interface is a male portion extending away from a BTE electronics module.

In an exemplary embodiment, the ear interface includes the three components and no more components: the ear hook tip, the ear hook chassis and the male connector. In an exemplary embodiment, the ear interface includes only two components and no more components: the ear hook tip and the ear hook chassis, with no male connector. In an exemplary embodiment, the ear interface includes only five components, the ear hook chassis, the ear hook tip, the male connector, the malleable spine of the lower C shape component and the body about which is molded or otherwise formed about the spine. In an exemplary embodiment, the ear interface only includes four components, the ear hook chassis, the ear hook tip, the male connector, and the body that forms the lower C shape, where, in this embodiment, there is no malleable spine located therein. That said, in an alternative exemplary embodiment, the ear interface includes only four components, the ear hook chassis, the ear hook tip, the male connector, and the spine utilized to provide support for the bottom C shape. Here, in this embodiment, the body that forms the lower C shape is a monolithic component with the body that forms the ear hook chassis 470.

Figure 32:
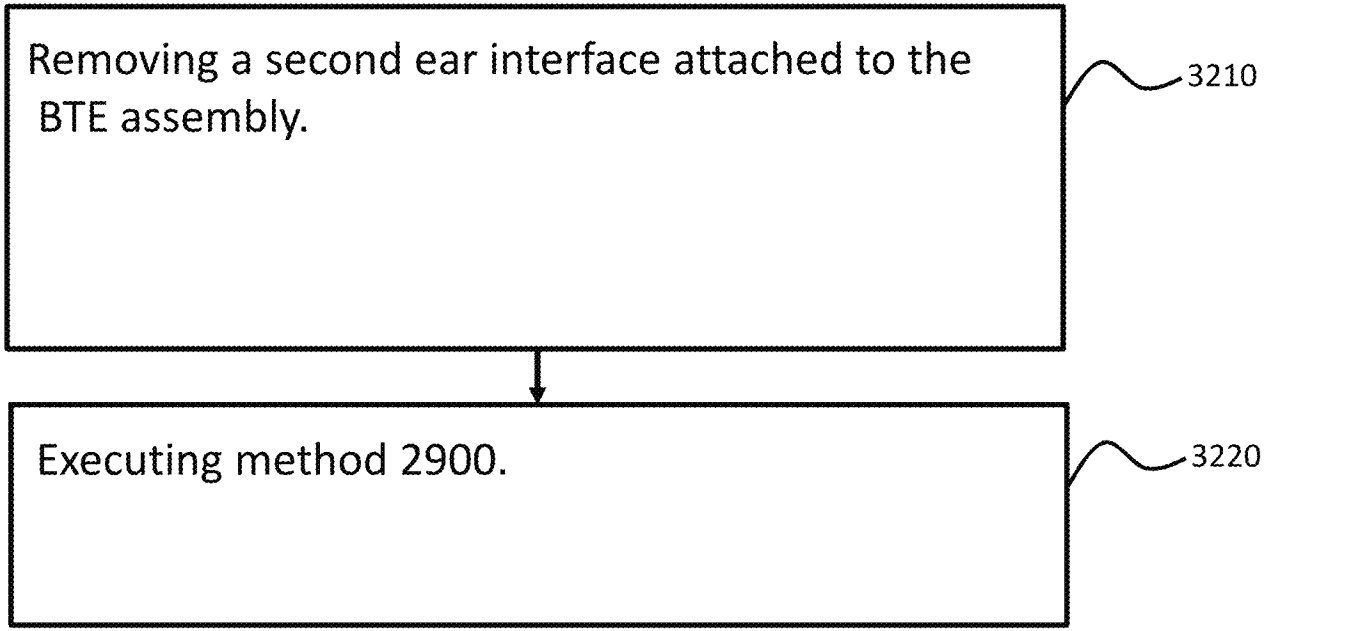

With respect to the methods detailed above, in an exemplary embodiment, prior to the action of obtaining the ear interface, the method includes removing a second ear interface attached to the BTE assembly, the second ear interface being of a different configuration than the obtained ear interface, the ear interface having a different BTE assembly attachment configuration than that of the second ear interface (e.g., the ear interface having a different BTE assembly attachment configuration could be a conventional ear hook, such as 490 above. Accordingly, with reference to FIG. 32, in an exemplary embodiment, there is a method, method 3200, which includes method action 3210, which include removing a second ear interface attached to the BTE assembly, and includes method action 3220, which includes executing method 2900, wherein the second ear interface is of a different configuration than the obtained ear interface. Again, it is noted that the second ear interface can be an ear hook 490, where the obtained ear interface obtained in method action 3220 is the ear hook apparatus 460. Note that in some alternative embodiments, the obtained ear interface obtained in method action 3220 could be different than ear hook apparatus 460, providing that such meets the other requirements of method 3220.

Also, in an exemplary embodiment, prior to the action of obtaining the ear interface in method 2900, the method includes removing a second ear interface attached to the BTE assembly, the second ear interface being of a different configuration than the obtained ear interface, the ear interface having a different BTE assembly attachment configuration than that of the second ear interface.

It is noted that the methods detailed herein are not limited to any particular order unless otherwise specified or unless it is not possible to practice such out of order. That is, while method 2800 presents method action 2810 in front of method action 2820, it is to be understood that method 2800 simply requires those two actions to be executed to practice the method.

It is also noted that at least some exemplary embodiments include retrofitting or otherwise modifying a BTE device to have a different size ear interface. That is, in contrast to the method 3200, which method is a method of changing one type of ear interface out and replacing it with another type of ear interface, in this exemplary method, the same type of ear interface is used, it is just that a new different size is the result of the modification.

In an exemplary embodiment, there is an ear hook apparatus, comprising:

an ear hook tip;

an ear hook chassis; and a male connector;

wherein the ear hook apparatus is configured to attach to a BTE electronics module such that the male connector interfaces with a base of the BTE electronics module.

In an exemplary embodiment of an apparatus described above and/or below, the ear hook chassis includes a female receptacle to receive a male portion of the BTE electronics module so as to attach the chassis to the BTE electronics module at the apex thereof; and the male connector is configured to lock the chassis to the BTE device. In an exemplary embodiment of an apparatus described above and/or below, the ear hook chassis is a separate component from the ear hook tip and the male connector; and the male connector is a separate component from the ear hook tip.

In an exemplary embodiment, there is a behind-the-ear (BTE) device, comprising:

a BTE electronics module; and an ear interface, wherein the ear interface is operationally removable from the BTE electronics module, the ear interface includes a portion configured to extend in front of a pinna when the BTE device is worn behind the ear, and the ear interface is safety connected to the BTE electronics module.

In an exemplary embodiment of the BTE device described above and/or below, the ear interface is only removable from the BTE device by removing a battery attached to the BTE electronics module. In an exemplary embodiment of the BTE device described above and/or below, the portion configured to extend in front of a pinna when the BTE device is worn behind the ear is an ear hook tip. In an exemplary embodiment of the BTE device described above and/or below, the portion configured to extend in front of a pinna when the BTE device is worn behind the ear is an ear loop.

In an exemplary embodiment, there is a method, comprising:

obtaining a behind-the-ear (BTE) assembly including a BTE electronics module;

obtaining an ear interface;

placing the ear interface against the BTE electronics module such that a portion of the interface extends into an area of the behind-the-ear assembly; and locking the ear interface to the BTE assembly via the portion extending into the area of the BTE assembly.

In an exemplary embodiment of the method described above and/or below, the portion of the ear interface is a male portion extending away from a BTE electronics module portion. In an exemplary embodiment of the method described above and/or below, the ear interface includes three sections including an ear hook section configured to extend in front of a pinna, a crown section configured to extend over the pinna, and a back section that extends behind the pinna, and the ear interface is configured to flex such that at least portions of the three sections pull away from the BTE electronics module while the ear interface is locked to the BTE assembly.

It is noted that any embodiment or feature disclosed herein associated with one embodiment can be combined with any other embodiment or any other feature disclosed herein associated with another embodiment unless otherwise specified or unless the art does not enable such. It is further noted that any disclosure herein of a device and/or system further corresponds to a disclosure of a method action of utilizing that device and/or system. Corollary to this is that any disclosure herein of a method action corresponds to a disclosure method action of a device and/or system for executing that method action. It is also noted that any method action herein detailed with respect to fabricating or otherwise making a device and/or system corresponds to a resulting device and/or system that results from that fabrication action. It is also noted that any device and/or system detailed herein corresponds to a disclosure of a method of making that device and/or system.

While various embodiments of the present invention have been described above, it should be understood that they have been presented by way of example only, and not limitation. It will be apparent to persons skilled in the relevant art that various changes in form and detail can be made therein without departing from the spirit and scope of the invention.

What is claimed is:

1. An ear hook apparatus, comprising:

an ear hook tip;

an ear hook chassis; and a male connector;

wherein the ear hook apparatus is configured to attach to a BTE electronics module such that the male connector interfaces with a base of the BTE electronics module, and wherein the ear hook apparatus is further configured to attach to a body of the BTE electronics module away from the base, and wherein the ear hook tip is located at a top of the ear hook apparatus and the ear hook tip is located at a first end of the resulting assembly of the BTE electronics module plus ear hook apparatus when the ear hook apparatus is attached to the BTE electronics module, the first end being opposite an end of the BTE electronics module having the base.

2. The ear hook apparatus of claim 1, wherein the ear hook chassis defines a female receptacle configured to receive a male portion of the body of the BTE electronics module, and thereby facilitate an attachment to the body of the BTE electronics module.

3. The ear hook apparatus of claim 1, wherein:

the male connector is a metal component establishing a concave hook relative to a BTE electronics module facing side of the ear hook assembly;

the chassis is a synthetic based component; and the chassis is molded about a portion of the male connector.

4. The ear hook apparatus of claim 1, wherein:

the ear hook tip is a separate component from the chassis and is locked onto the chassis.

5. The ear hook apparatus of claim 1, wherein:

the ear hook apparatus is configured for dual connection to an operational assembly of the BTE device.

6. The ear hook apparatus of claim 1, wherein:

the chassis is configured to readily flex relative to the male connector; and the ear hook apparatus is attached to the BTE electronics module such that the tip is closer to a first location of the BTE electronics module than to the base of the BTE electronics module, the first location being a location that is furthest away from the base of the BTE electronics module.

7. A behind-the-ear (BTE) device, comprising:

a BTE electronics module; and an ear interface, wherein the ear interface is operationally removable from the BTE electronics module, the ear interface includes a portion configured to extend in front of a pinna when the BTE device is worn behind the ear, and the ear interface is safety connected to the BTE electronics module, and at least one of:

a battery is attached to the BTE electronics module, and the safety connection is such that the ear interface cannot be removed from the BTE electronics module with the battery connected thereto without breaking the ear interface; or the ear interface is safety connected to the BTE electronics module via an interference connection relative to the BTE electronics module.

8. The BTE device of claim 7, wherein:

the ear interface in totality extends along the BTE electronics module to just beyond the end of the BTE electronics module.

9. The BTE device of claim 7, wherein:

the ear interface is configured to be completely interposed between a concave portion of the BTE electronics module and a pinna of the recipient when worn on the recipient.

10. The BTE device of claim 7, wherein:

ear interface is safety connected to the BTE electronics module via an via the interference connection relative to the BTE electronics module.

11. The BTE device of claim 7, wherein:

ear interface is safety connected to the BTE electronics module via a component of the ear interface that extends between the BTE electronics module and the battery attached to the BTE electronics module, wherein the battery has a housing that appears as a structural extension of the BTE electronics module extending downward away from the BTE electronics module.

12. A kit, comprising:

the BTE device of claim 7, and an ear hook, wherein the ear hook is removably attachable to the BTE electronics module when the ear interface is removed from the BTE device, and the ear hook is a different configuration from the ear interface.

13. A method, comprising:

obtaining a behind-the-ear (BTE) assembly including a BTE electronics module;

obtaining an ear interface;

placing the ear interface against the BTE electronics module such that a portion of the interface extends into an area of the behind-the-ear assembly; and attaching the ear interface to the BTE assembly via the portion extending into the area of the BTE assembly, wherein the action of placing the interface against the BTE electronics module results in the portion of the interface extending underneath the BTE electronics module and above a location for a battery of the BTE assembly such that the ear interface is attached to the BTE assembly.

14. The method of claim 13, wherein:

the BTE assembly includes the battery, wherein the battery is removably attachable to the BTE electronics module; and the action of placing the interface against the BTE electronics module results in the portion of the interface extending underneath the BTE electronics module into a battery interface section such that the ear interface is locked to the BTE assembly, wherein the battery interface section establishes a bottom face of the BTE electronics module.

15. The method of claim 13, wherein:

the BTE assembly includes the battery, wherein the battery is removably attachable to the BTE electronics module;

the action of placing the ear interface against the BTE electronics module results in the portion of the ear interface extending underneath the BTE electronics module into a battery interface; and the method further comprises attaching the battery to the BTE electronics module such that the portion extends between the BTE electronics module and the battery, wherein the action of attaching the battery to the BTE electronics module locks the ear interface to the BTE electronics module.

16. The method of claim 15, further comprising at least one of:

detaching the battery from the BTE electronics module, thereby unlocking the ear interface from the BTE assembly; or detaching the battery from the BTE electronics module, thereby enabling the ear interface to be removed from the BTE assembly.

17. The method of claim 13, wherein:

the action of placing the interface against the BTE electronics module also results in a second portion of the ear interface attaching to a separate portion of the BTE electronics module in a non-locking manner.

18. The method of claim 13, wherein:

prior to the action of obtaining the ear interface, the method includes removing a second ear interface attached to the BTE assembly, the second ear interface being of a different configuration than the obtained ear interface.

19. The method of claim 13, wherein:

prior to the action of obtaining the ear interface, the method includes removing a second ear interface attached to the BTE assembly, the second ear interface being of a different configuration than the obtained ear interface, the ear interface having a different BTE assembly attachment configuration than that of the second ear interface.

* * * * *